US012268942B2

(12) United States Patent
Woodward et al.

(10) Patent No.: US 12,268,942 B2
(45) Date of Patent: Apr. 8, 2025

(54) GOLF CLUB HEAD WITH ADJUSTABLE FITTING MECHANISMS

(71) Applicant: Karsten Manufacturing Corporation, Phoenix, AZ (US)

(72) Inventors: Alex G. Woodward, San Francisco, CA (US); Martin R. Jertson, Phoenix, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 38 days.

(21) Appl. No.: 18/311,199

(22) Filed: May 2, 2023

(65) Prior Publication Data

US 2023/0264081 A1 Aug. 24, 2023

Related U.S. Application Data

(63) Continuation of application No. 17/302,495, filed on May 4, 2021, now Pat. No. 11,638,860, which is a continuation of application No. 16/723,954, filed on Dec. 20, 2019, now Pat. No. 10,994,179.

(60) Provisional application No. 62/897,897, filed on Sep. 9, 2019, provisional application No. 62/783,987, filed on Dec. 21, 2018.

(51) Int. Cl.

| | |
|---|---|
| ***A63B 53/02*** | (2015.01) |
| ***A63B 53/06*** | (2015.01) |
| ***A63B 53/08*** | (2015.01) |
| *A63B 53/00* | (2015.01) |
| *A63B 53/04* | (2015.01) |

(52) U.S. Cl.

CPC ..... *A63B 53/065* (2013.01); *A63B 53/02* (2013.01); *A63B 53/023* (2020.08); *A63B 53/08* (2013.01); *A63B 53/007* (2013.01); *A63B 53/025* (2020.08); *A63B 53/026* (2020.08); *A63B 53/0441* (2020.08); *A63B 2053/0491* (2013.01)

(58) Field of Classification Search

CPC ..... A63B 53/06; A63B 53/022; A63B 53/065; A63B 53/02; A63B 53/026; A63B 53/007; A63B 53/023

See application file for complete search history.

(56) References Cited

U.S. PATENT DOCUMENTS

| | | | | | |
|---|---|---|---|---|---|
| 1,529,959 | A | * | 3/1925 | Martin | A63B 60/00 473/245 |
| 2,661,952 | A | | 12/1953 | Jackson | |
| 4,228,341 | A | * | 10/1980 | Zandberg | A61B 18/20 606/18 |
| 4,735,414 | A | | 4/1988 | Williams | |
| 4,736,951 | A | | 4/1988 | Grant | |

(Continued)

FOREIGN PATENT DOCUMENTS

| | | | | |
|---|---|---|---|---|
| GB | 2480871 | * | 7/2011 | A63B 53/007 |
| KR | 200319966 | * | 7/2003 | A63B 53/007 |

OTHER PUBLICATIONS

PCT International Search Report and Written Opinion dated Mar. 18, 2020 from corresponding PCT Application No. PCT/US2019/068128.

*Primary Examiner* — John E Simms, Jr.

(57) ABSTRACT

Embodiments of golf clubs with adjustable loft, lie, head mass and methods of manufacturing golf clubs with adjustable loft, lie, and head mass are generally described herein. Other embodiments can be described and claimed.

15 Claims, 19 Drawing Sheets

(56) References Cited

U.S. PATENT DOCUMENTS

| | | | | |
|---|---|---|---|---|
| 5,228,689 | A | 7/1993 | Donofrio, Sr. | |
| 5,244,205 | A | 9/1993 | Melanson | |
| 5,263,711 | A | 11/1993 | Addis | |
| 5,292,123 | A | 3/1994 | Schmidt | |
| 5,390,918 | A | 2/1995 | Meyers | |
| 5,390,919 | A | 2/1995 | Stubbs | |
| 5,393,056 | A * | 2/1995 | Richardson | A63B 53/06 473/247 |
| 5,407,196 | A | 4/1995 | Busnardo | |
| 5,533,730 | A | 7/1996 | Ruvang | |
| 5,577,726 | A | 11/1996 | Fenton | |
| 5,580,051 | A | 12/1996 | Fisher | |
| 5,716,287 | A | 2/1998 | Levocz | |
| 5,863,257 | A * | 1/1999 | Busnardo | A63B 53/065 473/307 |
| 6,095,929 | A | 8/2000 | Clark | |
| 6,213,889 | B1 * | 4/2001 | Hamburger | A63B 60/00 473/248 |
| 6,623,372 | B1 | 9/2003 | Beebe | |
| 8,870,674 | B1 | 10/2014 | Abbott | |
| 9,108,092 | B1 * | 8/2015 | Warner | A63B 53/06 |
| 9,272,193 | B1 * | 3/2016 | Yim | A63B 53/02 |
| 9,675,854 | B2 | 6/2017 | Wang | |
| 9,937,387 | B2 | 4/2018 | Wang | |
| 10,112,083 | B2 | 10/2018 | Jones | |
| 2006/0264264 | A1 | 11/2006 | Sandino | |
| 2011/0018305 | A1 | 1/2011 | Burns | |
| 2011/0230275 | A1 | 9/2011 | Hicks | |
| 2014/0090523 | A1 | 4/2014 | Hsieh | |
| 2014/0187344 | A1 | 7/2014 | Jones | |
| 2014/0378243 | A1 | 12/2014 | Sanyal | |
| 2015/0045137 | A1 | 2/2015 | Esposito | |
| 2015/0080143 | A1 | 3/2015 | Sanyal et al. | |
| 2015/0148146 | A1 | 5/2015 | Wolf | |
| 2015/0151169 | A1 | 6/2015 | Davis | |
| 2015/0258390 | A1 | 9/2015 | DeFrancesco | |
| 2015/0343285 | A1 * | 12/2015 | Franklin | A63B 60/54 473/333 |
| 2016/0059086 | A1 | 3/2016 | Miles | |
| 2016/0121178 | A1 | 5/2016 | Frankilin | |
| 2016/0184661 | A1 | 6/2016 | Barrett et al. | |
| 2016/0303438 | A1 | 10/2016 | Miles | |
| 2017/0014689 | A1 * | 1/2017 | Davis | A63B 53/007 |
| 2017/0239535 | A1 | 8/2017 | Brandt | |
| 2017/0296889 | A1 * | 10/2017 | Myers | A63B 53/02 |
| 2018/0104554 | A1 | 4/2018 | Sanyal | |
| 2019/0001196 | A1 | 1/2019 | Sizemore, Jr. | |
| 2020/0282267 | A1 * | 9/2020 | Hamburger | A63B 53/02 |

* cited by examiner

GOLF CLUB HEAD WITH ADJUSTABLE FITTING MECHANISMS

RELATED APPLICATION DATA

This is a continuation of U.S. patent application Ser. No. 17/302,495, filed on May 4, 2021, and is issued as U.S. Pat. No. 11,638,860 on May 2, 2023, which is a continuation of U.S. patent application Ser. No. 16/723,954, filed on Dec. 20, 2019, and is issued as U.S. Pat. No. 10,994,179 on May 4, 2021, which claims the benefit of U.S. Patent Application No. 62/897,897, filed on Sep. 9, 2019, and U.S. Patent Application No. 62/783,987, filed on Dec. 21, 2018, the contents of all of which above are entirely incorporate herein by reference.

FIELD

This disclosure relates generally to golf club heads and more particularly to putter-type golf club heads with adjustable fitting mechanisms.

BACKGROUND

Golf clubs can be fitted to an individual based upon the type of golf club, the individual's physical characteristics and/or the individual's playing style. Depending on the individual's physical characteristics and playing style, an individual can be fitted into a certain lie angle, loft angle, and/or head mass to provide optimum performance for the individual. Accordingly, each individual can require a golf club having a certain lie angle, loft angle, and head mass to fit the physical characteristics and playing style of the individual.

Typically, individuals turn to club fitters to learn more about their ideal putter configuration (loft angle, head mass, and/or lie angle). Conventional fitting putters used by club fitters typically require significant structural changes when compared to putter-type golf club heads used on a golf course. This negatively effects club head aesthetics, sight lines, and potentially the golfer's address position. This leads to individuals not being "fit" or optimized to the most suitable putter configuration. There is a need in the art for a fitting putter (that can alter the lie angle, loft angle, and head mass) to resemble a putter-type golf club head used on a golf course, such as a blade style putter.

DESCRIPTION

Figure 1:
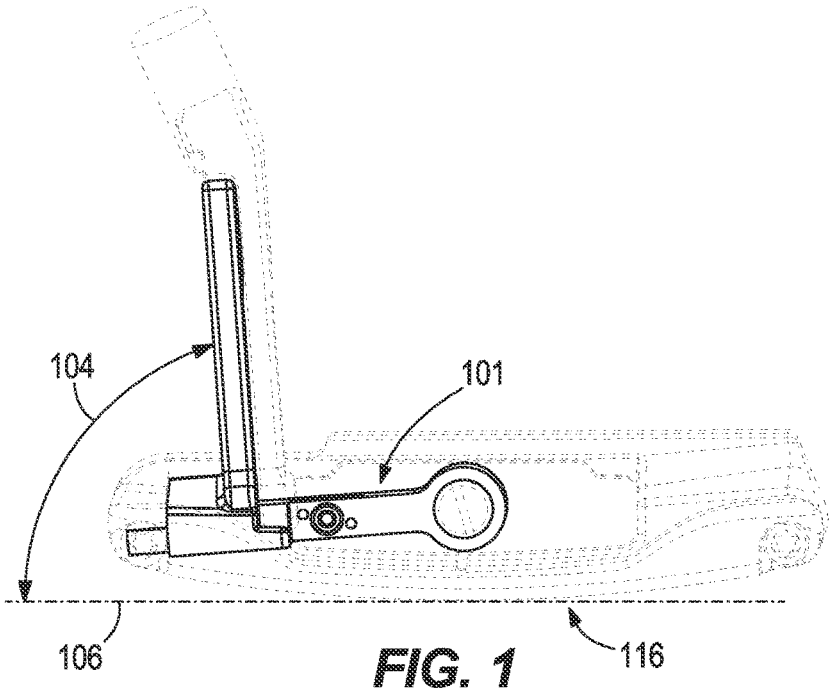
FIG. 1 shows a rear view of an adjustable lie angle mechanism according to one embodiment.

Presented herein are golf club heads with adjustable fitting mechanisms. The golf club heads described herein can be configured to structurally resemble a putter, while independently adjusting one or more parameters of the golf club head. Altering one or more parameters of the golf club head ("club head") can alter the configuration of the golf club head. Parameters that can alter the club head configuration can be lie angle, loft angle, head mass, or combinations thereof.

To adjust the one or more parameters of the golf club head, the golf club head comprises at least an adjustable lie angle mechanism, an adjustable loft angle mechanism, and an adjustable head mass mechanism. Each adjustable fitting mechanism (adjustable lie angle mechanism, adjustable loft angle mechanism, adjustable head mass mechanism) comprises one or more parts that is/are independent of the other adjustable fitting mechanism(s), and either directly or indirectly connects to a base or foundational piece.

The adjustable lie angle mechanism comprises a lie arm that attaches to the hosel body and generally extends in a heel-to-toe direction. The adjustable loft angle mechanism comprises a loft arm that generally extends in a top rail-to-sole direction and indirectly attaches to the hosel body. The adjustable head mass mechanism comprises an interchangeable rear ballast that extends substantially in a heel-to-toe direction. The hosel body and the adjustable head mass mechanism are attached and/or coupled to the club head body. This provides the opportunity for a user being fit to a putter-type golf club to maintain a similar address position, sight lines, and aesthetics as putter-type golf club heads used on golf courses.

The term or phrase "lie angle" used herein can be defined as being the angle between a golf shaft (not shown) and a playing surface once the sole contacts the playing surface. The lie angle of a golf club head can also be referred to as the angle formed by the intersection of the centerline of the golf shaft (not shown) and the playing surface when the sole of the golf club head is resting on the playing surface 106.

The term or phrase "integral" used herein can be defined as two or more elements, if they are comprised of the same piece of material. As defined herein, two or more elements are "non-integral" if each element is comprised of a different piece of material.

The term or phrase "couple", "coupled", "couples", and "coupling" used herein can be defined as connecting two or more elements, mechanically or otherwise. Coupling (whether mechanical or otherwise) can be for any length of time, e.g. permanent or semi-permanent or only for an instant. Mechanical coupling and the like should be broadly understood and include mechanical coupling of all types. The absence of the word "removably," "removable," and the like near the word "coupled," and the like does not mean that the coupling, in question is or is not removable.

The term or phrase "head weight" or "head mass" used herein can be defined as the total mass or weight of the putter.

The term or phrase "attach", "attached", "attaches, and "attaching" used herein can be defined as connecting or being joined to something. Attaching can be permanent or semi-permanent. Mechanically attaching and the like should be broadly understood and include all types of mechanical attachment means. Integral attachment means should be broadly understood and include all types of integral attachment means that permanently connects two or more objects together.

The term or phrase "loft angle" used herein can be defined as the angle between the front striking surface and the golf shaft. In other embodiments, the loft angle can be defined herein as such: the front striking surface comprises a strike face center point and a loft plane. The strike face center point is equidistant from (1) the lower edge and upper edge of the strike face, as well as, (2) equidistant from the heel end and toe end of the putter-type golf club head. The loft plane is tangent to the strike face of the putter type golf club head. The golf shaft comprises a centerline axis that extends the entire length of the golf shaft. The loft angle is between the centerline axis of the golf shaft and the loft plane of the putter. The loft angle of the putter-type golf club head can also be defined herein as the angle between the front striking surface and the golf shaft (not shown) when a centerline of the golf shaft is generally vertical (i.e. forms a generally 90° angle with the playing surface).

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but can include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The club head body described herein can further be defined by a coordinate system. The geometric center of the front striking surface defines an origin for a coordinate system having an x-axis, a y-axis, and z-axis, when the club head is at an address position. The x-axis extends through the geometric center of the front striking surface from near the heel end towards the toe end, and parallel to the playing surface. The y-axis extends through the geometric center of the front striking surface from near the top rail to the sole, and where the y-axis is perpendicular to the x-axis and the playing surface. The z-axis extends through the geometric center of the front striking surface towards the back surface. The z-axis is perpendicular to the x-axis and y-axis.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

I. Adjustable Fitting Mechanisms

Golf club heads having one or more adjustable fitting mechanisms are described herein. The parameters targeted for adjustment (but is not exhaustive) can be selected from the group consisting of the head mass (or head weight), lie angle, loft angle, and combinations thereof. The mechanisms for adjusting lie, adjusting loft, and/or adjusting head mass of the golf club head can be done through the adjustable lie angle mechanism, adjustable loft angle mechanism, and adjustable head mass mechanism, respectively. The golf club heads having an adjustable fitting mechanism can be a putter-type golf club head.

The putter-type golf club heads 100,200 described herein provides the ability to independently adjust one or more club head parameters. Specifically, the putter-type golf club heads can be configured to adjust lie angle, loft angle, and/or head mass. This is accomplished at least in part by creating a putter-type club head 100, 200 having: an adjustable lie angle mechanism 101, an adjustable loft angle mechanism 102, and an adjustable head mass mechanism 103.

The components of the adjustable lie angle mechanism 101 that aids in adjusting the lie angle of the putter-type golf club head comprises: (1) a post 120 connected to the rear surface 118 of the club head body 112, (2) a hosel comprising a hosel body 122, and (3) a lie arm 121 configured to engage both the post 120 of the club head body 112 and the hosel body 122. The lie arm 121 of the putter-type golf club head 100 is adapted to rotate around the outer circumferential surface of the post 120 in a top rail-to-sole direction (or about the z-axis). This type of rotation alters the lie angle of the golf club head 100, 200.

The components of the adjustable loft angle mechanism 102 that aids in adjusting the loft angle of the putter-type golf club head comprises: (1) the hosel body 122, (2) a hosel arm 127 extending from the hosel body 122 generally in a sole-to-top rail direction, and (3) a loft arm 128 rotatably connected to the hosel arm. The hosel arm 127 and the loft arm 128 are arranged to be pivotably and/or rotatably connected to each other to incrementally alter the loft angle of the golf club head.

In many embodiments, the putter-type golf club head 100,200 described herein mimics the design of a conventional blade style putter, while introducing the ability to independently adjust one or more club head parameters through the adjustable lie angle mechanism 101, the adjustable loft angle mechanism 102, and the adjustable head mass mechanism 103. This beneficially enables the golfer being "fit" to address the golf ball, as if they were playing a round of golf, therefore having similar sight lines and club head aesthetics to ensure to a higher degree that the golfer is fitted to the correct lie angle, loft angle, and/or head mass.

Another beneficial aspect of the putter-type club head 100, 200 described herein is the ability to alter the lie angle and/or loft angle in a variety of increments. For example, the adjustable lie angle mechanism 101 and/or adjustable loft angle mechanism 102 can be adjusted in half degree or one-degree increments. Adjusting the lie angle or loft angle in half-degree or one-degree increments ensures that the user is not only "fit" into integer-type loft angle and lie angle configurations, but also non-integer type loft angle and lie angle configurations.

Another beneficial aspect of the putter-type golf club head 100, 200 described herein is the ability to adjust the head mass of the putter-type golf club head. Adjusting the head mass of putter-type golf club heads provides the ability to fit golfers and/or individuals to accommodate different putter stroke tempos. A golfer or individual with a slower stroke tempo can be fit into a heavier putter and conversely, an individual with a faster stroke tempo can be fit into a lighter putter.

At least some illustrated embodiments of a golf club head according to this invention are described below. Such apparatus can include all or some of the above described components, features, and benefits.

II. Putter-Types Golf Club Heads Having Adjustable Fitting Mechanisms

In many embodiments, the golf club head is a putter-type golf club head (the putter type golf club head 100 and 200). FIGS. 1-38 illustrates exemplary embodiments of putter-type golf club heads having one or more adjustable fitting mechanisms. Specifically, in many embodiments, the putter-type golf club head can adjust one or more of the head mass (or head weight), the lie angle, and/or the loft angle. The putter-type golf club head can be a mallet-type putter head, mid-mallet type putter head, a blade type putter head, a high MOI putter head, or any other putter-type golf club head.

1. Loft Angle

In many embodiments, the putter-type golf club head (hereafter "golf club head" or "club head") can have a loft angle less than 10 degrees. In many embodiments, the loft angle of the club head can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, or less than 5 degrees. For further example, the loft angle of the club head can be 0-degree, 1 degree, 2 degrees, 3 degrees, 4 degrees, 5 degrees, 6 degrees, 7 degrees, 8 degrees, 9 degrees, or 10 degrees.

2. Weight

In many embodiments, the putter-type golf club head can have a weight that ranges between 320 and 385 grams. In other embodiments, the putter-type golf club head can range between 320 grams-325 grams, 325 grams-330 grams, 330 grams-335 grams, 335 grams-340 grams, 340 grams-345 grams, 345 grams-350 grams, 350 grams-355 grams, 355 grams-360 grams, 360 grams-365 grams, 365 grams-370 grams, 370 grams-375 grams, 375 grams-380 grams, or 380 grams-385 grams. In some embodiments, the weight of the putter-type golf club head can be 320 grams, 321 grams, 322 grams, 323 grams, 324 grams, 325 grams, 326 grams, 327 grams, 328 grams, 329 grams, 330 grams, 331 grams, 332 grams, 333 grams, 334 grams, 335 grams, 336 grams, 337 grams, 338 grams, 339 grams, 340 grams, 341 grams, 342 grams, 343 grams, 344 grams, 345 grams, 346 grams, 347 grams, 348 grams, 349 grams, 350 grams, 351 grams, 352 grams, 353 grams, 354 grams, 355 grams, 356 grams, 357 grams, 358 grams, 359 grams, 360 grams, 361 grams, 362 grams, 363 grams, 364 grams, 365 grams, 366 grams, 367 grams, 368 grams, 369 grams, 370 grams, 371 grams, 372 grams, 373 grams, 374 grams, 375 grams, 376 grams, 377 grams, 378 grams, 379 grams, 380 grams, 381 grams, 382 grams, 383 grams, 384 grams, or 385 grams.

3. Material

The material of the putter-type golf club head can be constructed from any material used to construct a conventional golf club head. For example, the material of the putter-type golf club head can be constructed from any one or combination of the following: 8620 alloy steel, S25C steel, carbon steel, maraging steel, 17-4 stainless steel, 1380 stainless steel, 303 stainless steel, stainless steel alloys, tungsten, aluminum, aluminum alloys, ADC-12, titanium, titanium alloys, or any metal for creating a golf club head. In many embodiments, the putter-type golf club head is constructed from stainless-steel.

4. Composition of Putter-Type Golf Club Head

In many embodiments, the putter-type golf club head comprises a club head body 112. The club head body 112 comprises a toe end 113, a heel end 114, a top rail 115, a sole 116, a front striking surface 117, a rear surface 118, and a back surface 119. The front striking surface 117 provides a striking surface for striking a golf ball (not shown). The rear surface 118 is rearwardly spaced from the front striking surface 117. The back surface 119 is opposite or distal from the front striking surface 117 and the rear surface 118. The sole 116 is defined as being between the back surface 119 and the front striking surface 117. The top rail 115 can be formed opposite the sole 116. The front striking surface 117 is defined by a heel end 114 and a toe end 113, which is opposite the heel end 114.

In further embodiments, the club head body 112 comprises a post 120. The post 120 extends from the rear surface 118 of the club head body towards the back surface 119 of the club head body 112. In many embodiments, the post 120 is integrally formed to the club head body 112 (or attaches or couples) to the club head body 112. Preferably, the geometry of the post 120 is in the form of a tubular or cylindrical elongation to enable a component of the adjustable lie angle mechanism 101 to slide over and reside on the outer circumferential surface of the post 120. When a component of the adjustable lie angle mechanism 101, for example, a lie arm 121 slides over and resides on the outer circumferential surface of the post 120, this effectively defines a pivot surface for the adjustable lie angle mechanism 101 to rotate about. Thereby, altering the lie angle of the putter-type golf club head.

III. Introduction—Adjustable Fitting Mechanisms

FIGS. 1-10 illustrates various embodiments of the golf club head comprising one or more adjustable fitting mechanism(s) (i.e. an adjustable lie angle mechanism 101, an adjustable loft angle mechanism 102, an adjustable head mass mechanism 103, etc.). The mechanisms for adjustable lie 101, adjustable loft 102, and adjustable head mass 103 can be independently adjusted or altered. Each adjustable fitting mechanism comprises two figures, which illustrates a first configuration of the putter-type golf club head 100 and upon adjustment by the one or more adjustable fitting mechanism(s) 101, 102, 103, a second club head configuration.

1. Introduction—Adjustable Lie Angle Mechanism

Figure 2:
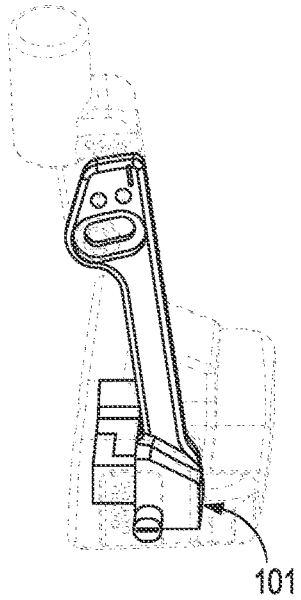
FIG. 2 shows a heel view of the adjustable lie angle mechanism of FIG. 1
Figure 3:
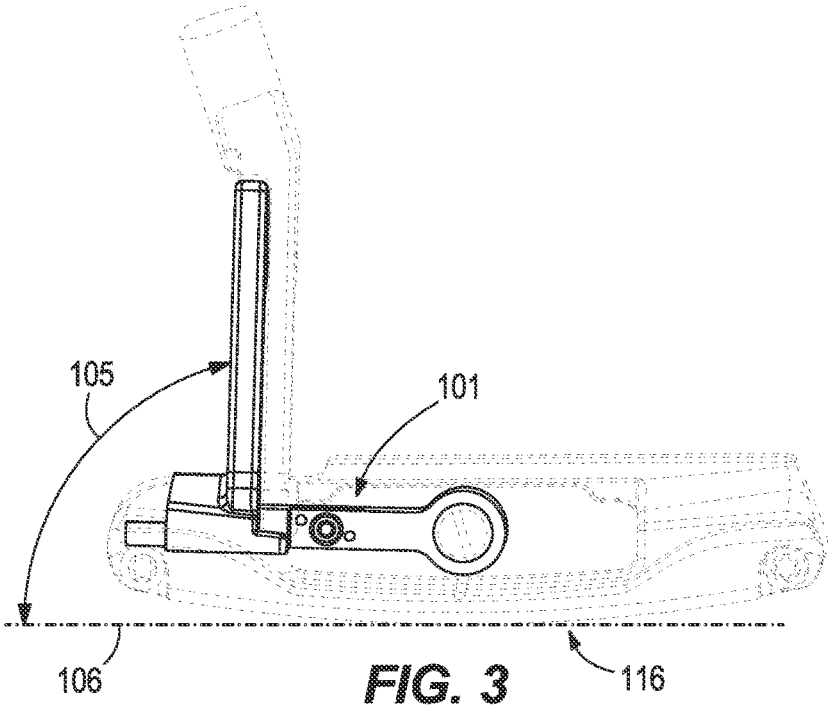
FIG. 3 shows a rear view of the adjustable lie angle mechanism in a second lie angle state according to one embodiment.
Figure 4:
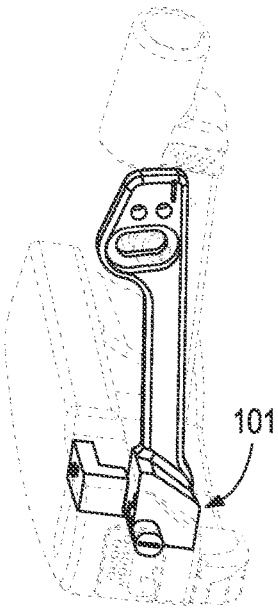
FIG. 4 shows a heel view of the adjustable lie angle mechanism of FIG. 3.

For example, FIGS. 1-4 provides an exemplary embodiment of the golf club head comprising an adjustable lie angle mechanism 101 changing from a first configuration to a second configuration. A rear and side view of a first lie angle state 104 is shown in FIGS. 1 and 2. FIGS. 3 and 4 provides an illustration of the lie angle changing from the first lie angle state 104 to a second lie angle state 105 due to the adjustable lie angle mechanism 101. This second lie angle state 105 changes the configuration of the putter-type golf club head to a second club head configuration. As seen in reference to FIGS. 3 and 4, the lie angle of the golf club head can be adjusted by altering the position of the adjustable lie angle mechanism 101 in a top rail-to-sole direction (or rotating about the z-axis).

2. Introduction—Adjustable Loft Angle Mechanism

Figure 5:
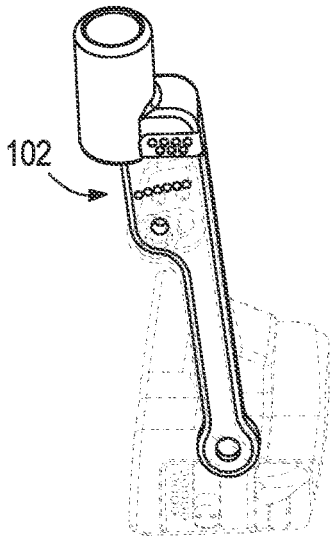
FIG. 5 shows a heel view of an adjustable loft angle mechanism according to one embodiment.
Figure 6:
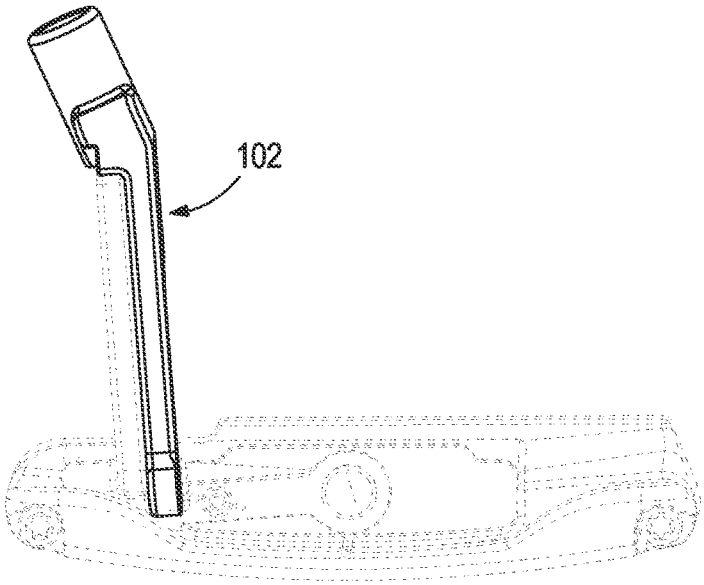
FIG. 6 shows a rear view of the adjustable loft angle mechanism according to FIG. 5.
Figure 7:
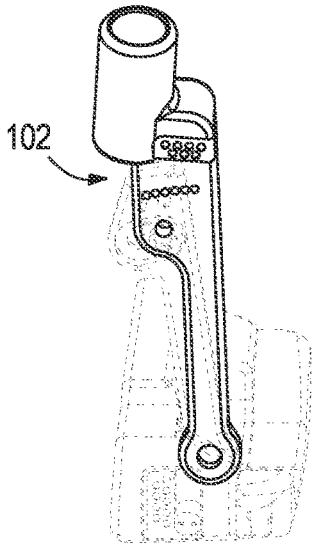
FIG. 7 shows a heel view of the adjustable loft angle mechanism in a second loft angle state.
Figure 8:
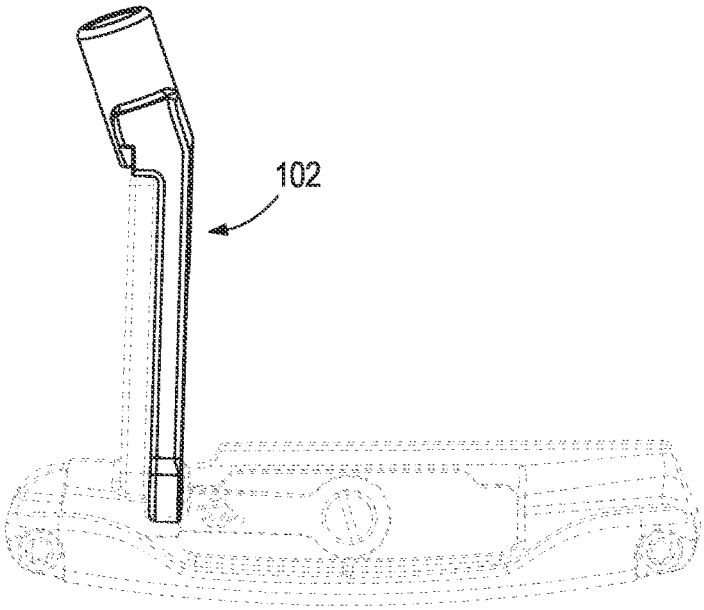
FIG. 8 shows a rear view of the adjustable loft angle mechanism according to FIG. 7.

Another example of the golf club head comprising one or more adjustable fitting mechanisms is illustrated in FIGS. 5-8. FIGS. 5-8 provides an exemplary embodiment of an adjustable loft angle mechanism 102 changing from a first configuration to a second configuration. Rear and side views of a first loft angle state 107 is shown in FIGS. 5 and 6. Rear and side views of a second loft angle state 108 is shown in FIGS. 7 and 8. FIGS. 7 and 8 provide an illustration of the loft angle changing from the first loft angle state 107 to a second loft angle state 108 due to the adjustable loft angle mechanism 102. The second loft angle state 108 changes the configuration of the putter-type golf club head to a second club head configuration. Referencing FIGS. 5-8, the loft angle of the putter-type golf club head can be adjusted by altering the position of the adjustable loft angle mechanism 102 in a front-to-rear direction (or rotating about the x-axis).

3. Introduction—Adjustable Head Mass Mechanism

Figure 9:
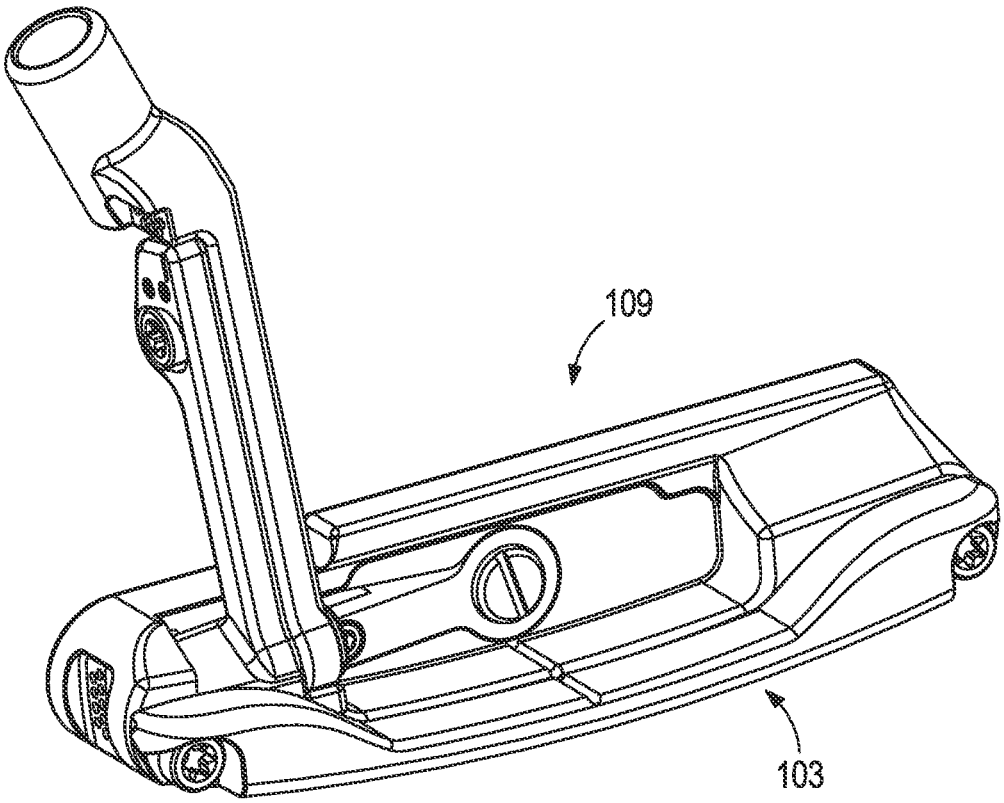
FIG. 9 shows a rear perspective view of an adjustable head mass mechanism according to one embodiment.
Figure 10:
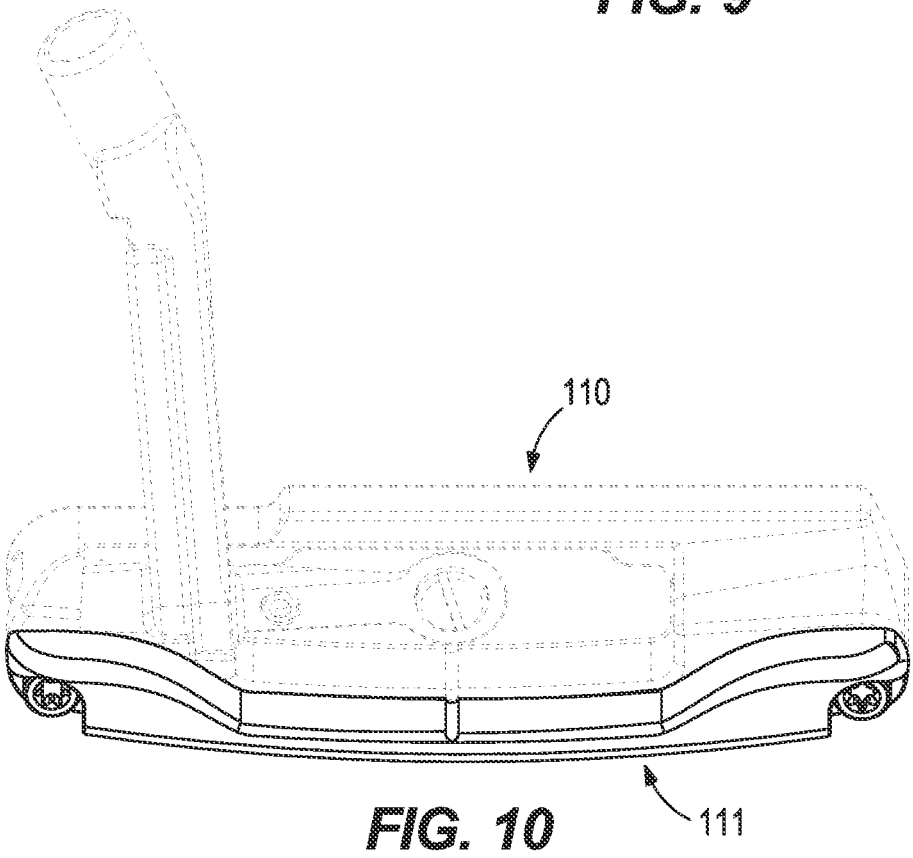
FIG. 10 shows a rear view of an adjustable head mass mechanism in a second putter mass configuration.
Figure 11:
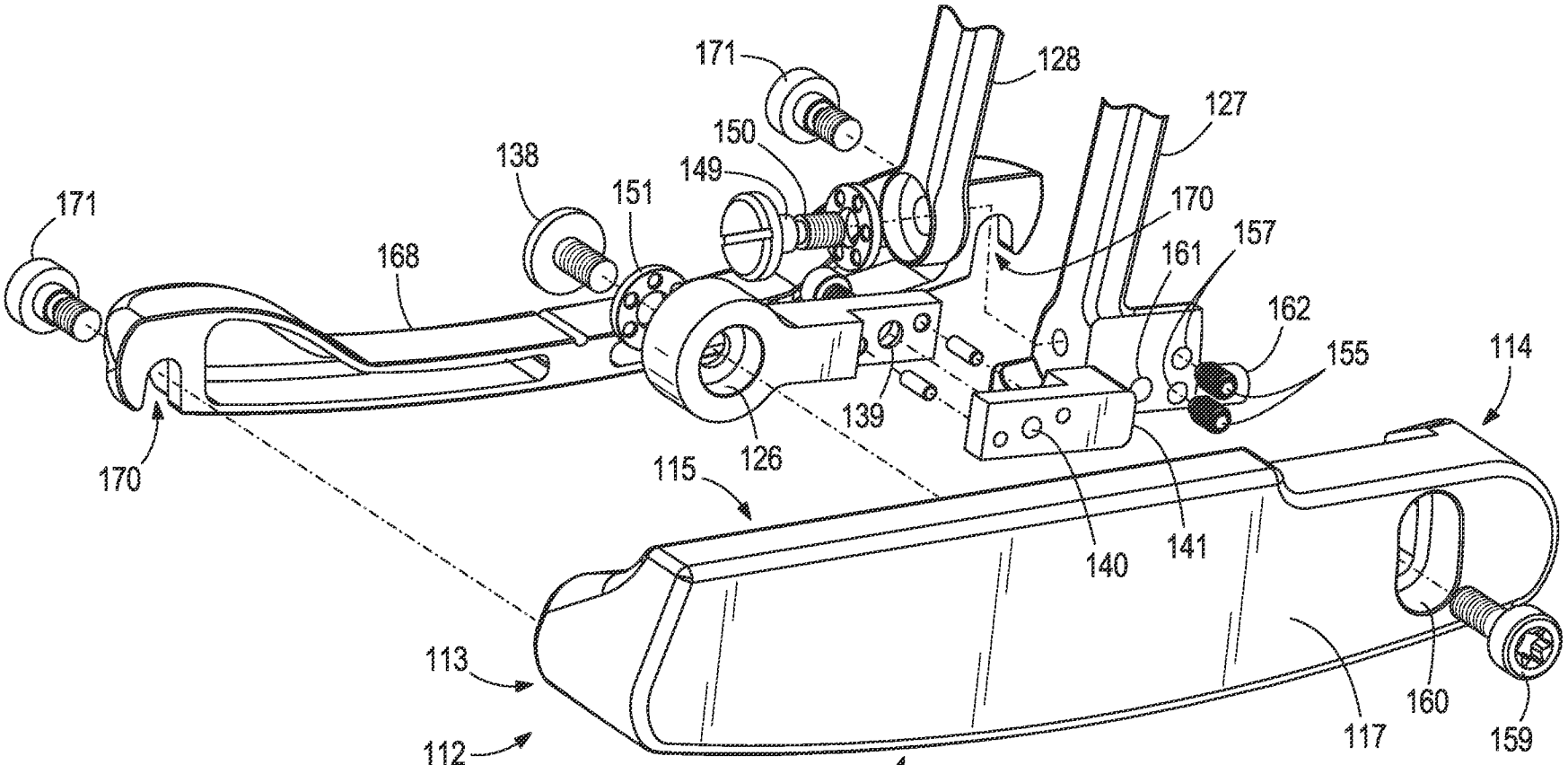
FIG. 11 shows a front exploded view of a putter-type golf club head according to one embodiment.

Another example of the golf club head comprising one or more adjustable fitting mechanisms is illustrated in FIGS. 9 and 10. FIGS. 9 and 10 provide an exemplary embodiment of an adjustable head mass mechanism 103 changing from a first configuration to a second configuration. FIG. 9. is an exemplary embodiment of an adjustable head mass mechanism 103 in a first putter mass configuration 109. FIG. 10 provides an illustration of the head mass changing from a first putter mass configuration 109 to a second putter pass configuration 110 due to the adjustable head mass mechanism 103. The second putter mass configuration 110 changes the configuration of the putter-type golf club head to a second club head configuration. As seen in FIG. 10, the head mass of the putter type golf club head 100 can be adjusted by interchanging the weight of the putter type golf club through a plurality of interchangeable rear ballasts 111 configured to have different weights or masses.

4. Component of Adjustable Lie Angle Mechanism—Lie Arm

As described, one of the adjustment mechanisms can be a lie angle adjustment mechanism. One element or component of the adjustable lie angle mechanism 101 is a lie arm 121 that extends generally in a heel-to-toe direction (see FIG. 13). The lie arm 121 is configured to incrementally adjust a lie angle of the putter-type golf club head 100 when the lie arm 121 rotates around the outer circumferential surface of the post 120. The lie angle of the putter-type golf club head 100 can be adjusted between 60 degrees and 84 degrees. In many embodiments, the lie angle of the putter-type golf club head 100 can be adjusted between 60 degrees-64 degrees, 64 degrees-68 degrees, 68 degrees-72 degrees, 72 degrees-76 degrees, 76 degrees-80 degrees, or 80 degrees-84 degrees. In other embodiments, the lie angle of the putter type golf club head 100 can be adjusted to 60 degrees, 61 degrees, 62 degrees, 63 degrees, 64 degrees, 65 degrees, 66 degrees, 67 degrees, 68 degrees, 69 degrees, 70 degrees, 71 degrees, 72 degrees, 73 degrees, 74 degrees, 75 degrees, 76 degrees, 77 degrees, 78 degrees, 79 degrees, 80 degrees, 81 degrees, 82 degrees, 83 degrees, or 84 degrees. In a preferred embodiment, the lie angle of the putter-type club head 100 can be adjusted between 66 degrees and 74 degrees in 0.5-degree or 1-degree increments (i.e. 66°, 66.5°, 67°, 67.5°, 68°, 68.5°, 69°, 69.5°, 70°, 70.5°, 71°, 71.5°, 72°, 72.5°, 73°, 73.5°, or 74°).

In some of the embodiments, the lie arm 121 is either coupled or integrally joined to a hosel body 122. Both coupling and integrally joining the lie arm 121 to the hosel body 122 presents beneficial advantages that will be discussed below.

Coupling or attaching the lie arm 121 to the hosel body 122 reduces manufacturing material waste, as the hosel body 122 and lie arm 121 can be manufactured as separate components (i.e. separate CNC milling paths). Integrally forming the lie arm 121 to the hosel body 122 permits easier assembly, as less components are required (i.e. less components to connect to each other).

The lie arm 121 comprises a first end 123 ("lie arm first end" 123), a center portion 124 ("lie arm center portion)", and a second end 125 ("lie arm second end"). The lie arm first end 123 is closer to the heel end 114 of the club head body 112 (relative to the lie arm second end 125) and connects to the hosel body 122 (e.g. through coupling means or integral joining means). Further, coupling (Embodiment I) or integrally joining (Embodiment II) the first end 123 of the lie arm 121 and the hosel body 122 together will be discussed in greater detail below. The second end 125 of the lie arm 121 is closer to the toe end 113 of the club head body 112 (relative to the lie arm first end 123) and forms a receiving geometry 126 that is complimentary with the geometry of the post 120. The arrangement of the receiving geometry 126 of the lie arm 121 and the post 120 enables the lie arm 121 to rotate and/or pivot around the post 120 (i.e. altering the lie angle of the putter-type golf club head). The lie arm center portion 124 is in between the lie arm first end 123 and the lie arm second end 125.

In some embodiments, the lie arm 121 comprises a length, a width, and a height. The length of the lie arm 121 is measured in a direction extending from the heel end 114 to the toe end 113 of the club head body 112. The width of the lie arm 121 is measured in a direction extending from the front striking surface 117 to the back surface 119 of the club head body 112. The height of the lie arm is measured in a direction extending in the top rail 115 to sole 116 direction. The dimensional ranges for the length, the width, and the height of the lie arm 121 will be discussed below.

The length of the lie arm 121 is smaller than the total length of the club head body 112. The length of the lie arm 121 can range between 0.25 inch and 5 inches. In many embodiments, the length of the lie arm 121 can range between 0.25 inch-0.50 inch, 0.50 inch-0.75 inch, 0.75 inch-1.0 inch, 1.0 inch-1.25 inch, 1.25 inch-1.5 inch, 1.5 inch-2.0 inch, 2.0 inch-2.5 inch, 2.5 inch-3.0 inch, 3.0 inch-3.5 inch, 3.5 inch-4.0 inch, 4.0 inch-4.5 inch, or 4.5 inch-5.0 inch. In alternative embodiments, the length of the lie arm 121 can be approximately less than 5 inches, less than 4.5 inches, less than 4 inches, less than 3.5 inches, less than 3 inches, less than 2.5 inches, less than 2.0 inches, less than 1.5 inches, less than 1 inch, or less than 0.5 inch. In specific embodiments, the length of the lie arm 121 can be approximately 0.25 inch, 0.50 inch, 0.75 inch, 1.0 inch, 1.25 inches, 1.50 inches, 1.75 inches, 2.0 inches, 2.25 inches, 2.50 inches, 2.75 inches, 3.0 inches, 3.25 inches, 3.5 inches, 3.75 inches, 4.0 inches, 4.25 inches, 4.5 inches, 4.75 inches, or approximately 5.0 inches. The length of the lie arm 121 can vary based upon the desired adjustment resolution. For example, a lie arm 121 that is longer in length permits greater adjustment resolution as a user can more easily control the rate at which the lie arm 121 rotates around the post 120 (i.e. controlling the rate at which the lie angle of the putter-type golf club head 100 changes).

As described above, the second end 125 of the lie arm 121 forms and/or defines the receiving geometry 126. The receiving geometry 126 of the lie arm 121 can be complimentary with the geometry of the post 120. In many embodiments, a portion of the receiving geometry 126 can be defined by an indentation. The depth of the indentation is similar to the depth of the post 120 (which is measured in a direction extending between the front striking surface and back end of the club head body). This ensures that enough surface area of the lie arm's receiving geometry 126 engages or contacts the outer surface of the post 120 to create a suitable rotatable connection means. The arrangement of the lie arm receiving geometry 126, the lie arm 121, and the post geometry forms a fulcrum.

The material of the lie arm 121 can be constructed from any material used to construct a conventional club head body 112. For example, the material of the lie arm 121 can be constructed from any one or combination of the following: 8620 alloy steel, S25C steel, carbon steel, maraging steel, 17-4 stainless steel, 1380 stainless steel, 303 stainless steel, stainless steel alloy, tungsten, aluminum, aluminum alloy, ADC-12, titanium, titanium alloy, or any metal for creating a golf club head 100. In many embodiments, the lie arm 121 is made of a stainless-steel alloy or 303 stainless steel.

5. Adjustable Loft Angle Mechanism—Hosel Arm

As discussed above, the adjustable loft angle mechanism 102 comprises a hosel arm 127. The hosel arm 127 extends from the hosel body 122 in a generally top rail-to-sole direction. The hosel arm 127 comprises: a length, a width, and a height. The hosel arm 127 can integrally extend from the hosel body 122 or can be mechanically coupled to the hosel body 122. Similarly, as described above, the length of the hosel arm 127 is measured in a direction extending from the heel end 114 to the toe end 113 of the club head body 112 at an address position. The width of the hosel arm 127 is measured in a direction extending from the front striking surface 117 to the back surface 119 of the club head body 112 at an address position. The height of the hosel arm 127 is measured in a direction extending from the top rail 115 to the sole 116 of the club head body 112 at an address position.

The length, the width, and the height of the hosel arm 127 can vary to achieve desired mechanical properties. The length of the hosel arm 127 can vary to resist potential bending moments and stresses imposed on the hosel arm 127 that is induced by the user. For example, the length of the hosel arm 127 can be lengthened to prevent permanent deformation. The length of the hosel arm 127 can range between 0.09 inch to 0.5 inch. In many embodiments, the length of the hosel arm 127 ranges between 0.09 inch to 0.12 inch, 0.12 inch to 0.15 inch, 0.15 inch-0.18 inch, 0.18 inch-0.21 inch, 0.21 inch-0.24 inch, 0.24 inch-0.27 inch, 0.27 inch-0.30 inch, 0.30 inch-0.33 inch, 0.33 inch-0.36 inch, 0.36 inch-0.39 inch, 0.39 inch-0.42 inch, 0.42 inch-0.45 inch, 0.45 inch-0.48 inch, or 0.48-0.5 inch. In specific embodiments, the length of the hosel arm 127 can be approximately 0.193 inches.

The width of the hosel arm 127 can vary to decrease the potential of excessive wearing, for example, warping. The width of the hosel arm 127 can vary between 0.20 inch and 1.0 inch. In many embodiments, the width of the hosel arm 127 can be between 0.20 inch-0.25 inch, 0.25 inch-0.30 inch, 0.30 inch-0.35 inch, 0.35 inch-0.40 inch, 0.40 inch-0.45 inch, 0.45 inch-0.50 inch, 0.50 inch-0.55 inch, 0.55 inch-0.60 inch, 0.60 inch-0.65 inch, 0.65 inch-0.70 inch, 0.70 inch-0.75 inch, 0.75 inch-0.80 inch, 0.80 inch-0.85 inch, 0.85 inch-0.90 inch, 0.90 inch-0.95 inch, or 0.95 inch-1.00 inch. In specific embodiments, the width of the hosel arm 127 can be approximately 0.250-inch, 0.350-inch, 0.450-inch, 0.550-inch, 0.650-inch, 0.750-inch, 0.850-inch, or 0.950-inch.

The height of the hosel arm 127 is preferably less than the height of a loft arm 128. The loft arm 128 pivotably connects to the hosel arm 127. This pivotable connection means alters the loft angle of the putter-type golf club head 100. In many embodiments, the structural arrangement of the loft arm 128 and hosel arm 127 are configured to mimic a blade style hosel design (hereafter "hosel"). This arrangement of the loft arm 128 and hosel arm 127 beneficially reduces the bulkiness of the hosel to create a compact hosel design. The height of the hosel arm 127 can vary according to the height of the loft arm 128.

The height of the hosel arm 127 can range between 0.5 inch and 4 inches. In other embodiments, the height of the hosel arm 127 can range between 0.5 inches-0.75 inches, 0.75 inches-1.0 inch, 1.0 inch-1.25 inches, 1.25 inches-1.50 inches, 1.50 inches-1.75 inches, 1.75 inches-2.0 inches, 2.0 inches-2.25 inches, 2.25 inches-2.50 inches, 2.50 inches-2.75 inches, 2.75 inches-3.0 inches, 3.0 inches-3.25 inches, 3.25 inches-3.50 inches, 3.50 inches-3.75 inches, or 3.75 inches-4.0 inches. In alternative embodiments, the height of the hosel arm 127 can be 0.5-inch, 1.0 inch, 1.5 inches, 2.0 inches, 2.5 inches, 3.0 inches, 3.5 inches, or 4 inches.

The material of the hosel arm 127 can be constructed from any material used to construct a conventional club head body 112. For example, the material of the hosel arm 127 can be constructed from any one or combination of the following: 8620 alloy steel, S25C steel, carbon steel, maraging steel, 17-4 stainless steel, 1380 stainless steel, 303 stainless steel, stainless steel alloy, tungsten, aluminum, aluminum alloy, ADC-12, titanium, titanium alloy, or any metal for creating a golf club head. In many embodiments, the hosel arm 127 is made of a stainless-steel alloy or 303 stainless steel.

6. Adjustable Loft Angle Mechanism—Loft Arm

As discussed above, the adjustable loft angle mechanism 102 further comprises a loft arm 128. The loft arm 128 is pivotally connected to the hosel arm 127 to alter the loft angle of the putter-type golf club head 100, 200. In many embodiments, the loft arm 128 is configured to couple to a golf shaft (not shown). The loft arm 128 comprises a first end 129 ("loft arm first end") and a second end 130 ("loft arm second end"). The loft arm first end 129 is spaced from the loft arm second end 130. The loft arm second end 130 is positioned closer to the hosel body 122 than the loft arm first end 129. Specifically, in many of the illustrated embodiments, the hosel arm 127 and the loft arm 128 are pivotably engaged to one another at the hosel arm second end 131 and the loft arm second end 130, respectively. The loft arm 128 can rotate about the hosel arm 127 about the x-axis.

This type of pivotably engaged connection means between the loft arm 128 and the hosel arm 127 permits an incremental change in the loft angle of the golf club head 100. The loft angle of the golf club head is adjusted when the loft arm 128 pivots about the hosel arm 127 in a front striking surface to back surface direction (or about the x-axis). In general, and more preferably, the loft arm 128 is positioned above a portion of the hosel body 122. This enables the loft arm 128 to freely rotate or pivot about the hosel arm second end 131, thereby allowing the loft angle of the putter-type golf club head 100 to be incrementally adjusted.

The loft angle of the putter-type golf club head 100 can be adjusted between 0 and 10 degrees. In many embodiments, the loft angle of the putter-type golf club head 100 can be adjusted between 0 degrees-1 degrees, 1 degree-2 degrees, 2 degrees-3 degrees, 3 degrees-4 degrees, 4 degrees-5 degrees, 5 degrees-6 degrees, 6 degrees-7 degrees, 7 degrees-8 degrees, 8 degrees-9 degrees, or 9 degrees-10 degrees. In other embodiments, the loft angle of the putter type golf club head 100 can be adjusted to 0 degrees, 1 degree, 2 degrees, 3 degrees, 4 degrees, 5 degrees, 6 degrees, 7 degrees, 8 degrees, 9 degrees, or 10 degrees. In a preferred embodiment, the loft angle of the putter-type club head 100 can be adjusted between 0 degrees and 5 degrees in 0.25-degree or 1-degree increments (i.e. 0°, 0.25°, 0.50°, 0.75°, 1°, 1.25°, 1.5°, 1.75°, 2.0°, 2.25°, 2.5°, 2.75°, 3°, 3.25°, 3.5°, 3.75°, 4°, 4.25°, 4.5°, 4.75°, 5°) .

7. Adjustable Lie Angle Mechanism, Adjustable Loft Angle Mechanism—Hosel Body

The adjustable lie angle mechanism 101 and adjustable loft angle mechanism 102 can comprise a hosel body. The hosel body 122 can be a component of both the adjustable lie angle mechanism 101 and adjustable loft angle mechanism 102 that indirectly connects the hosel arm 127, loft arm 128, and the lie arm 121 to one another. In many embodiments, the hosel body 122 provides a foundational piece or base structure that aids in coordinating, aligning, and/or connecting the hosel arm 127, loft arm 128, and lie arm 121 to a single region or portion of the hosel 172. In other words, the hosel body 122 efficiently connects the adjustable lie angle mechanism 101 to the adjustable loft angle mechanism 102, while still enabling independent adjustment of one or more club head parameters (i.e. loft angle and lie angle).

In many embodiments, the hosel body 122 can take the form of a substantially rectangular shape. In other embodiments, the hosel body 122 can be substantially square, rectangular, polygonal, semi-circular, curvilinear, or combinations thereof. In general, and more preferably, the hosel body 122 is substantially rectangular. Having a hosel body 122 that is substantially rectangular creates a flat matting surface for the hosel body 122 to sit flush against the club head body 112.

The material of the hosel body 122 can be constructed from any material used to construct a conventional club head body 112. For example, the material of the hosel body 122 can be constructed from any one or combination of the following: 8620 alloy steel, S25C steel, carbon steel, maraging steel, 17-4 stainless steel, 1380 stainless steel, 303 stainless steel, stainless steel alloy, tungsten, aluminum, aluminum alloy, ADC-12, titanium, titanium alloy, or any metal for creating a golf club head. In many embodiments, the hosel body 122 is made of a stainless-steel alloy or 303 stainless steel.

I. EMBODIMENT I

Putter Type Club Head Having Lie Angle Mechanism and Loft Angle Mechanism associated with Hosel Body

Putter-Type Golf Club Head—Club Head Body

FIGS. 1-35 illustrates an embodiment according to this invention. More particularly, FIGS. 1-35 illustrates an example of a putter-type golf club head 100 to be used by a golfer (not shown) for identifying the golfer's preferred lie, loft, and preferred weight of the putter for a consistent, and accurate putting stroke. The putter-type golf club head 100 comprises a club head body 112. The club head body 112 comprises a front striking surface 117, a rear surface 118 spaced from the front striking surface 117, a back surface 119 opposite the front striking surface 117, a sole 116 extending between the front striking surface 117 and the back surface 119, a top rail 115 opposite the sole 116, and the front striking surface 117 disposed between the heel end 114 and the toe end 113.

The rear surface 118, the sole 116, and the top rail 115 of the putter-type golf club head can define a dual recess arrangement 132 having a first shallow recess 133 and a second deeper recess 134. The first shallow recess 133 can form the second deeper recess 134. The first shallow recess 133 is recessed inwardly towards the front striking surface approximately 0.02 inches from the rear surface 118. In other embodiments, the first shallow recess 133 can be recessed inwardly from the rear surface 118 and vary in depth between 0.01 inch to approximately 0.75 inch. Specifically, in many embodiments, the first shallow recess 133 can range between 0.01 inch-0.05 inch, 0.05 inch-0.10 inch, 0.10 inch-0.15 inch, 0.15 inch-0.20 inch, 0.20 inch-0.25 inch, 0.25 inch-0.30 inch, 0.30 inch-0.35 inch, 0.35 inch-0.40 inch, 0.40 inch-0.45 inch, 0.45 inch-0.50 inch, 0.50 inch-0.55 inch, 0.55 inch-0.60 inch, 0.60 inch-0.65 inch, 0.65 inch-0.70 inch, or 0.70 inch-0.75 inch.

As mentioned above, the first shallow recess 133 forms the second deeper recess 134. The second deeper recess 134 has a greater depth than the first shallow recess 133. With continued reference to FIG. 12, the depth of the second deeper recess 134 is approximatively 0.28 inches from the rear surface 118. In other embodiments, the second deeper recess 134 can be recessed inwardly from the rear surface 118 towards the front striking surface 117 and vary in depth between 0.02 inch and 1.0 inch. In alternative embodiments, the second deeper recess 134 depth can range between 0.02 inch to 0.12 inch, 0.12 inch-0.22 inch, 0.22 inch-0.32 inch, 0.32 inch-0.42 inch, 0.42 inch-0.52 inch, 0.52 inch-0.62 inch, 0.62 inch-0.72 inch, 0.72 inch-0.82 inch, 0.82 inch-0.92 inch, or 0.92 inch to approximately 1.0 inch. As will be described in more detail below, the second deeper recess 134 provides a puzzle-locking geometry to secure the club head components and/or adjustable fitting mechanisms 101, 102, 103 to the club head body 112.

Post of Club Head Body

Figure 12:
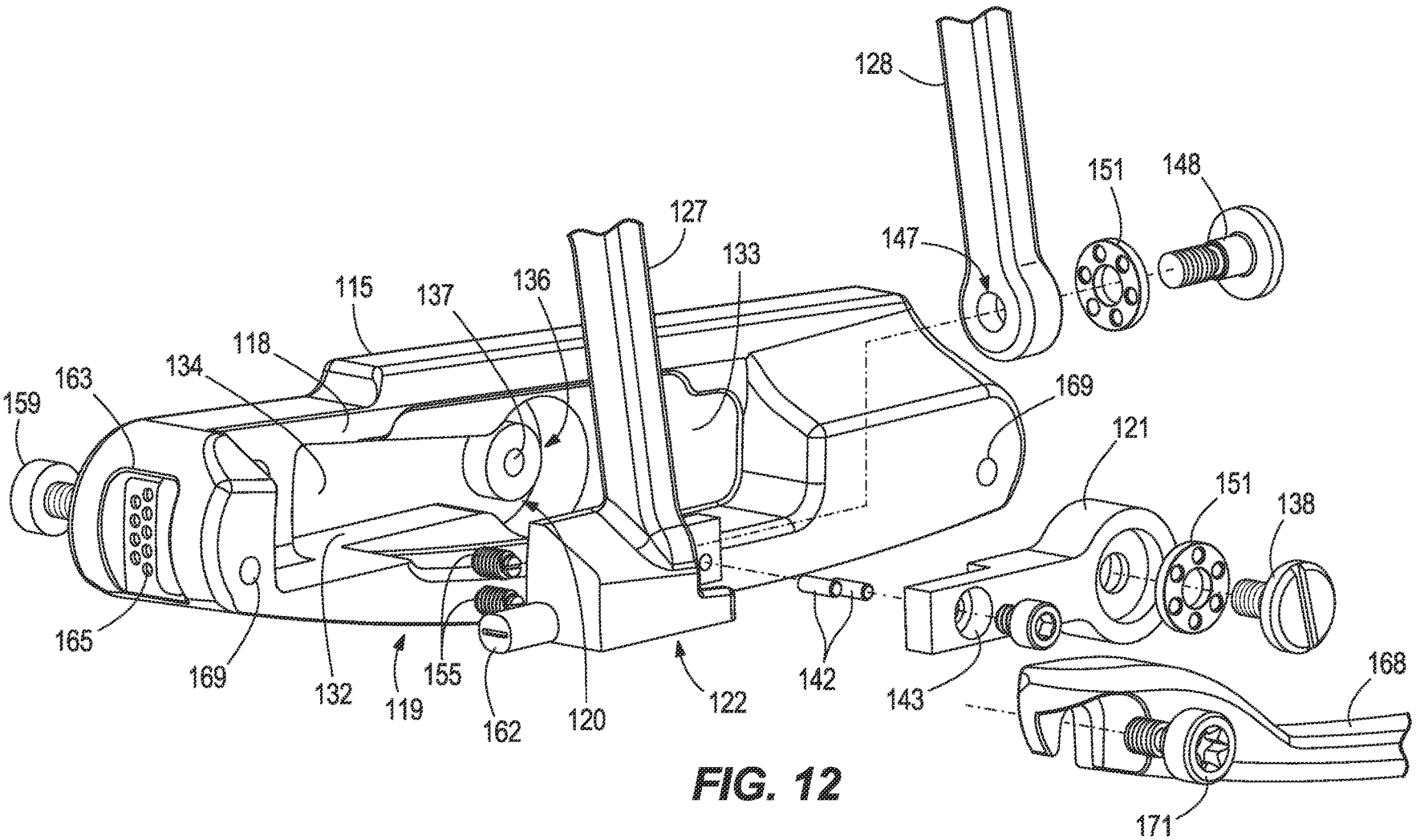
FIG. 12 shows a rear exploded view of the putter-type golf club head of FIG. 11.
Figure 13:
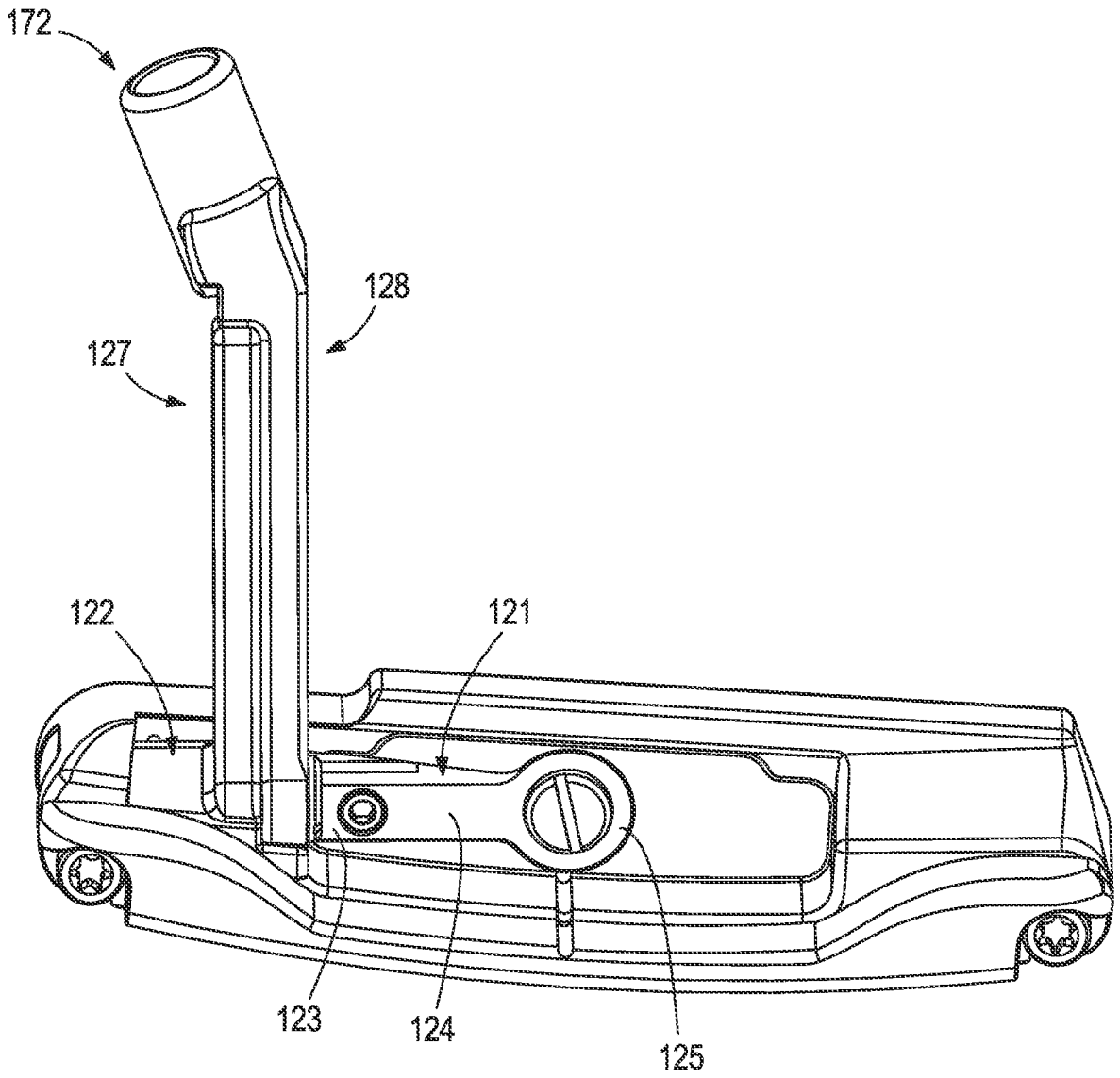
FIG. 13 shows an assembled rear view of the putter-type golf club head of FIG. 12.
Figure 19:
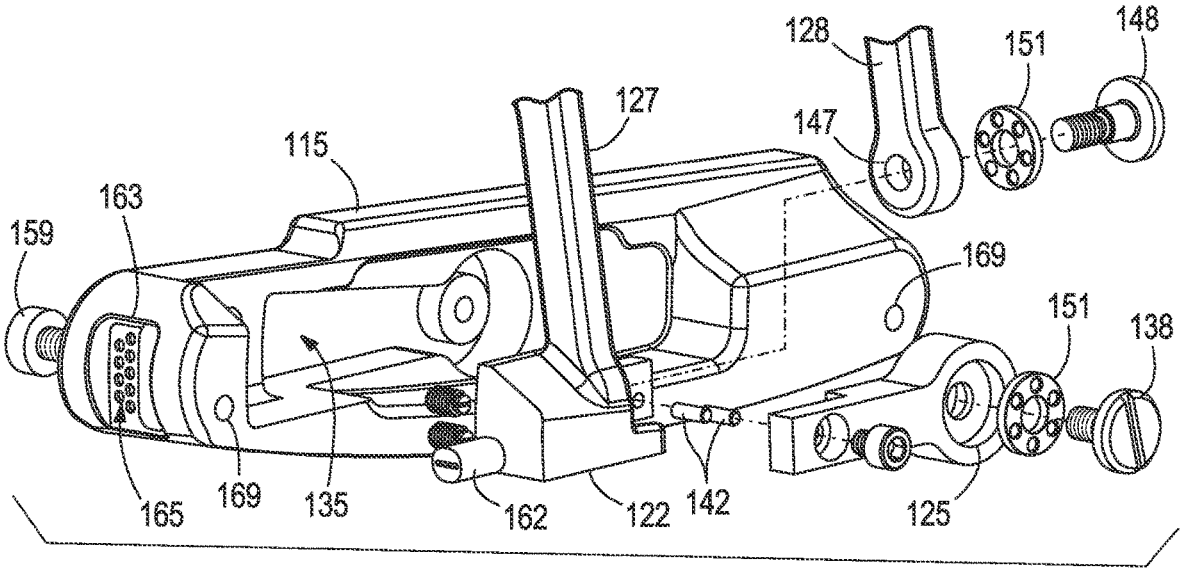
FIG. 19 shows a rear exploded view of the putter-type golf club head according to one embodiment.

Referencing FIG. 12 and FIG. 19, this embodiment illustrates the putter-type clubhead further comprising a post 120 extending from a wall 135 proximal to the front striking surface 117 (can also be referred to as "bottom wall" 135) of the second deeper recess 134. The post 120 can be integrally connected to the bottom wall 135 of the second deeper recess 134 and extends generally in a direction from the front striking surface 117 to the back surface 119. As illustrated in this embodiment, the geometry of the post 120 can be substantially cylindrical. However, in other alternative embodiments, it can be any curvilinear geometry that permits rotation of a lie arm 121 along the outer peripheral surface of the post 120 (or about the z-axis). The post 120 is configured to receive the receiving geometry 126 of the lie arm 121. Upon engagement of the receiving geometry 126 resting upon the outer surface of the post 120, the lie arm 121 can rotate. Thereby, affecting the lie angle of the putter-type golf club head 100.

The post 120 further can be defined by having an axial surface 136 ("rear post surface"), a post diameter, and a post depth. A portion of the axial surface 136 forms an aperture 137 (hereafter "post aperture" 137) that can or can not be threaded. In many embodiments and as illustrated in FIG. 12, the post aperture 137 can be threaded, centrally located on the axial surface 136, and has a depth extending in the back surface 119 to the front striking surface 117 direction.

The post aperture 137 can be configured to receive a fastener 138. The diameter and depth of the post aperture 137 can vary according to the dimensional characteristics of the fastener 138. In this specific embodiment, the diameter of the post aperture 137 is approximately 0.107 inch and the depth of the post aperture 137 is approximately 0.170 inch. The fastener 138 is inserted through the receiving geometry 126 of the lie arm 121 and configured to threadably engage the post aperture 137. This clamp and braces the lie arm 121 to the club head body 112.

The diameter of the post 120 can vary to have a smaller diameter (i.e. more compact design) or a larger diameter (i.e. to control adjust resolution). The diameter of the post 120 can vary between 0.05 inch and 1 inch. In many embodiments, the diameter of the post 120 can range between 0.05 inch to 0.10 inch, 0.10 inch-0.15 inch, 0.15 inch-0.20 inch, 0.20 inch-0.25 inch, 0.25 inch-0.30 inch, 0.30 inch-0.35 inch, 0.35 inch-0.40 inch, 0.40 inch-0.45 inch, 0.45 inch-0.50 inch, 0.50 inch-0.55 inch, 0.55 inch-0.60 inch, 0.60 inch-0.65 inch, 0.65 inch-0.70 inch, 0.70 inch-0.75 inch, 0.75 inch-0.80 inch, 0.80 inch-0.85 inch, 0.85 inch-0.90 inch, 0.90 inch-0.95 inch, or 0.95 inch-1.0 inch. In specific embodiments, the diameter of the post 120 can be 0.100 inch, 0.110 inch, 0.120 inch, 0.130 inch, 0.140 inch, 0.150 inch, 0.160 inch, 0.170 inch, 0.180 inch, 0.190 inch, 0.200 inch, 0.210 inch, 0.220 inch, 0.230 inch, 0.240 inch, 0.250 inch, 0.260 inch, 0.270 inch, 0.280 inch, 0.290 inch, 0.300 inch, 0.310 inch, 0.320 inch, 0.330 inch, 0.340 inch, 0.350 inch, 0.360 inch, 0.370 inch, 0.380 inch, 0.390 inch, or approximately 0.400 inch.

Additionally, as mentioned above, the depth of the post's 120 outer peripheral surface can vary according to the depth of the lie arm's 121 receiving geometry 126. Requiring that the depth of the post 120 and receiving geometry 126 of the lie arm 121 are similar ensures that the lie arm 121 engages enough of the outer peripheral surface area of the post's 120 exterior sidewall to enable sufficient rotation. The depth of the post 120 can vary between 0.05 inch and 1.5 inches. In many embodiments, the depth of the post 120 can range between 0.05 inch to 0.10 inch, 0.10 inch-0.15 inch, 0.15 inch-0.20 inch, 0.20 inch-0.25 inch, 0.25 inch-0.30 inch, 0.30 inch-0.35 inch, 0.35 inch-0.40 inch, 0.40 inch-0.45 inch, 0.45 inch-0.50 inch, 0.50 inch-0.55 inch, 0.55 inch-0.60 inch, 0.60 inch-0.65 inch, 0.65 inch-0.70 inch, 0.70 inch-0.75 inch, 0.75 inch-0.80 inch, 0.80 inch-0.85 inch, 0.85 inch-0.90 inch, 0.90 inch-0.95 inch, or 0.95 inch-1.0 inch. In specific embodiments, depth of the post can be approximately 0.80-inch, 0.90-inch, 1.0-inch, 1.10-inch, 1.20 inch, 1.30 inch, 1.40 inch, 1.50 inch, 1.60 inch, 1.70 inch, 1.80 inch, 1.90 inch, 2.00 inch, 2.10 inch, or 2.50 inches.

The location or position of the post 120 can be positioned anywhere on the rear surface 118 of the club head body 112. Specifically, in some embodiments, the post 120 can be centrally positioned between the heel end 114 and toe end 113 of the club head body 112. In other embodiments, the post 120 can be positioned anywhere on the rear surface 118 of the club head body 112 between the toe end 113 and heel end 114. For example, the post 120 can be positioned proximal to the toe end 113 or the post 120 can be positioned proximal to the heel end 114. In other embodiments, the post 120 can be located on the rear surface 118 of the club head body 112 between the heel end 114 and a geometric center of the front striking surface 117 or located between the toe end 113 and the geometric center of the front striking surface 117. In alternative embodiments, the post 120 can be positioned directly rearward of the geometric center of the front striking surface 117.

As described above, the diameter of the post aperture 137 can vary according to the geometry of the fastener 138. The diameter of the post aperture 137 can vary between 0.05 inch and 1.5 inches. In many embodiments, the diameter of the post aperture 137 can range between 0.05 inch to 0.10 inch, 0.10 inch-0.15 inch, 0.15 inch-0.20 inch, 0.20 inch-0.25 inch, 0.25 inch-0.30 inch, 0.30 inch-0.35 inch, 0.35 inch-0.40 inch, 0.40 inch-0.45 inch, 0.45 inch-0.50 inch, 0.50 inch-0.55 inch, 0.55 inch-0.60 inch, 0.60 inch-0.65 inch, 0.65 inch-0.70 inch, 0.70 inch-0.75 inch, 0.75 inch-0.80 inch, 0.80 inch-0.85 inch, 0.85 inch-0.90 inch, 0.90 inch-0.95 inch, or 0.95 inch-1.0 inch. In specific embodiments, the diameter of the post aperture 137 can be 0.080 inch, 0.081 inch, 0.082 inch, 0.083 inch, 0.084 inch, 0.085 inch, 0.086 inch, 0.087 inch, 0.088 inch, 0.089 inch, 0.090 inch, 0.091 inch, 0.092 inch, 0.093 inch, 0.094 inch, 0.095 inch, 0.096 inch, 0.097 inch, 0.098 inch, 0.099 inch, 0.100 inch, 0.101 inch, 0.102 inch, 0.103 inch, 0.104 inch, 0.105 inch, 0.106 inch, 0.107 inch, 0.108 inch, 0.109 inch, 0.110 inch, 0.111 inch or 0.115 inch.

Additionally, as described above, the depth of the post aperture 137 can vary according to the geometry characteristics of the fastener 138. The depth of the post aperture 137 can vary between 0.05 inch and 1.0 inches. In many embodiments, the depth of the post aperture 137 can range between 0.05 inch to 0.10 inch, 0.10 inch-0.15 inch, 0.15 inch-0.20 inch, 0.20 inch-0.25 inch, 0.25 inch-0.30 inch, 0.30 inch-0.35 inch, 0.35 inch-0.40 inch, 0.40 inch-0.45 inch, 0.45 inch-0.50 inch, 0.50 inch-0.55 inch, 0.55 inch-0.60 inch, 0.60 inch-0.65 inch, 0.65 inch-0.70 inch, 0.70 inch-0.75 inch, 0.75 inch-0.80 inch, 0.80 inch-0.85 inch, 0.85 inch-0.90 inch, 0.90 inch-0.95 inch, or 0.95 inch-1.0 inch. In specific embodiments, the depth of the post aperture 137 can be 0.090 inch, 0.100 inch, 0.110 inch, 0.120 inch, 0.130 inch, 0.140 inch, 0.150 inch, 0.160 inch, 0.170 inch, 0.180 inch, 0.190 inch, 0.200 inch, 0.210 inch, or 0.250 inch.

Adjustable Lie Angle Mechanism a. Mechanical Connection of the Lie Arm to the Hosel Body

As discussed above, the putter-type club head can comprise an adjustable lie angle mechanism 101. The lie angle mechanism comprises components associated with the hosel body 122 for the putter-type club head. One of the components of the adjustable lie angle mechanism 101 is the lie arm 121. The lie arm 121 couples to both the post 120 of the club head body 112 and the hosel body 122 (see FIGS. 11, 12, 14, and 15). This type of connection means between the lie arm 121, post 120, and hosel body 122 aids in forming some elements of the adjustable lie angle mechanism 101. As described above, and for further reiteration, the receiving geometry 126 engages and rest upon the outer surface of the post 120. To alter the lie angle of the club head, since the lie arm 121 and hosel body 122 are coupled to each other, one of the lie arm 121 or hosel body 122 needs to be translated in a top rail-to-sole direction (or rotated about the z-axis). Thereby, causing the receiving geometry 126 of the lie arm 121 to rotate around the outer surface of the post 120, thus causing the lie angle to change.

Figure 35:
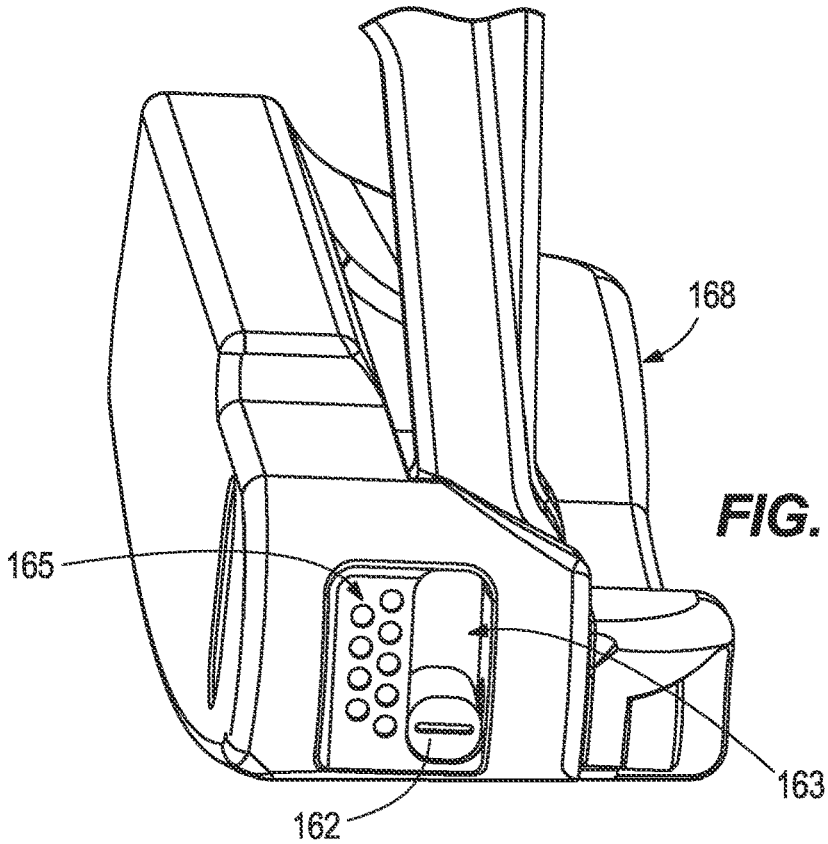
FIG. 35 shows an assembled heel view of the putter-type golf club head of FIG. 34.

In some embodiments, the hosel body 122 further includes a hosel tab 162 (see FIG. 35). The hosel tab can be integrally connected to the hosel body 122. The hosel tab 162 extends in a heel end 114 to toe end 113 direction. In some embodiments, the hosel tab 162 is partially exposed at a heel end 114 of the club head body 112. The hosel tab 162 is configured to be a physical indicator of the current lie angle of the putter-type golf club head 100 and provide a handle or knob to adjust the lie angle. For example, a hand of the fitter (not shown) can engage the hosel tab 162 and manipulate the hosel tab 162 in a top rail-to-sole direction to alter the lie angle to a different position. The hosel tab 162 and the lie arm 121 are indirectly coupled to each other (through the hosel body 122), thus upon movement of the hosel tab 162, the lie arm 121 rotates about the post, thereby altering the lie angle of the club head 100 and movement of the hosel tab 162.

In some embodiments, the lie arm 121 and the hosel body 122 are affixed to each other through mechanical coupling means (i.e. one or more fasteners). The fastener(s) not only provides a detachably engaged connection means with the hosel body 122, but also coupling the lie arm 121 to the hosel body 122 through fasteners provides beneficial manufacturing advantages as outlined above. These advantages include, but are not limited to, reducing manufacturing material waste, as the hosel body 122 and lie arm 121 can be manufactured as separate components (i.e. separate CNC milling paths). For further iteration, the lie arm 121 is a separate part, element, or component from the hosel body 122.

Referencing FIGS. 11, 12, 14 and 15, the first end 123 of the lie arm 121 is mechanically coupled to the hosel body 122. This type of mechanically coupling means can be in the form of bolts, fasteners, etc. For example, in this embodiment, a plurality of lie arm apertures 139 are formed proximal to the lie arm first end 123. In many embodiments, a plurality of lie arm apertures 139 can be referred to as one or more lie arm apertures, two or more lie arm apertures, three or more lie arm apertures, four or more lie arm apertures, five or more lie arm apertures, six or more lie arm apertures, or seven or more lie arm apertures. The plurality of lie arm apertures 139 are arranged to align with a plurality of hosel body apertures 140. The lie arm apertures 139 and the hosel body apertures 140 are aligned and configured to receive one or more mechanical fastener(s) (i.e. bolts, screws, pins, or other mechanical fasteners) to couple and align the lie arm 121 to the hosel body 122 or vice versa.

Similarly, the hosel body 122 forms a plurality of hosel body apertures 140 configured to align with the plurality of lie arm apertures 139 formed at the lie arm's first end 123. The plurality of hosel body apertures 140 and the plurality of lie arm apertures 139 extends either entirely through their respective structure or partially therethrough. The plurality of hosel body apertures 140 and the plurality of lie arm apertures 139 are configured to be aligned with one another, such that a fastener, a bolt, a screw, a pin or combinations thereof are configured to be received within each corresponding aligned aperture of the hosel body 122 and lie arm 121.

Figure 23:
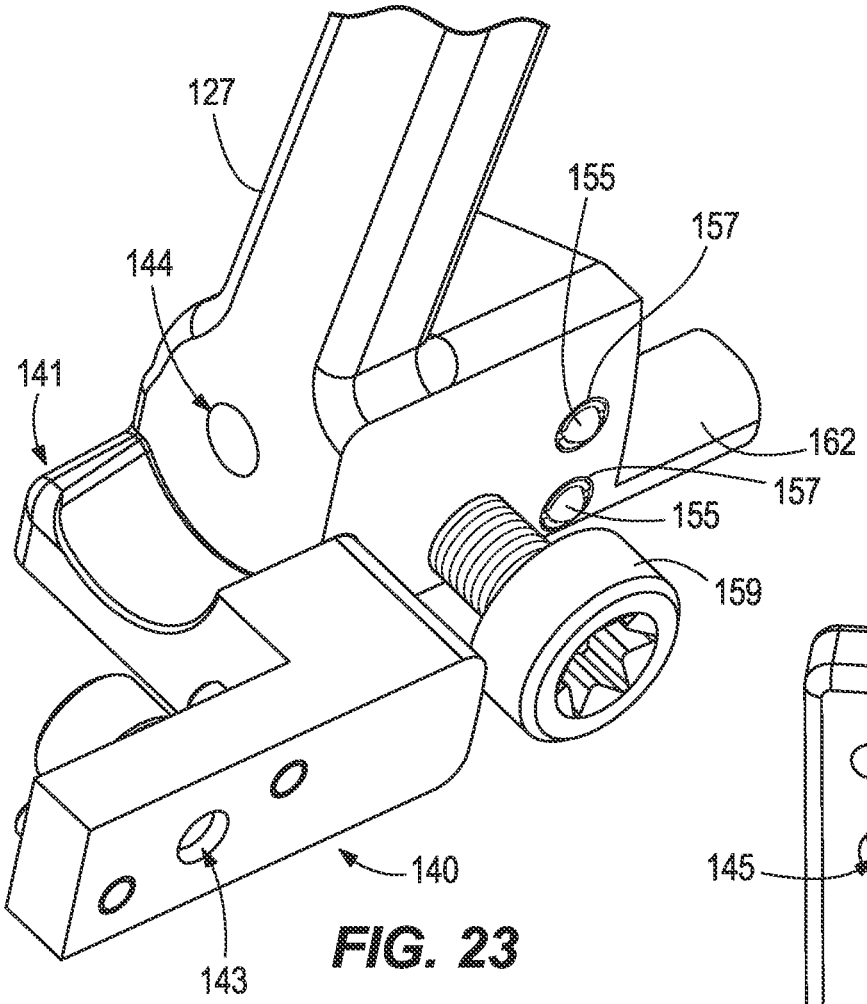
FIG. 23 shows a close-up partial view of FIG. 21.
Figure 24:
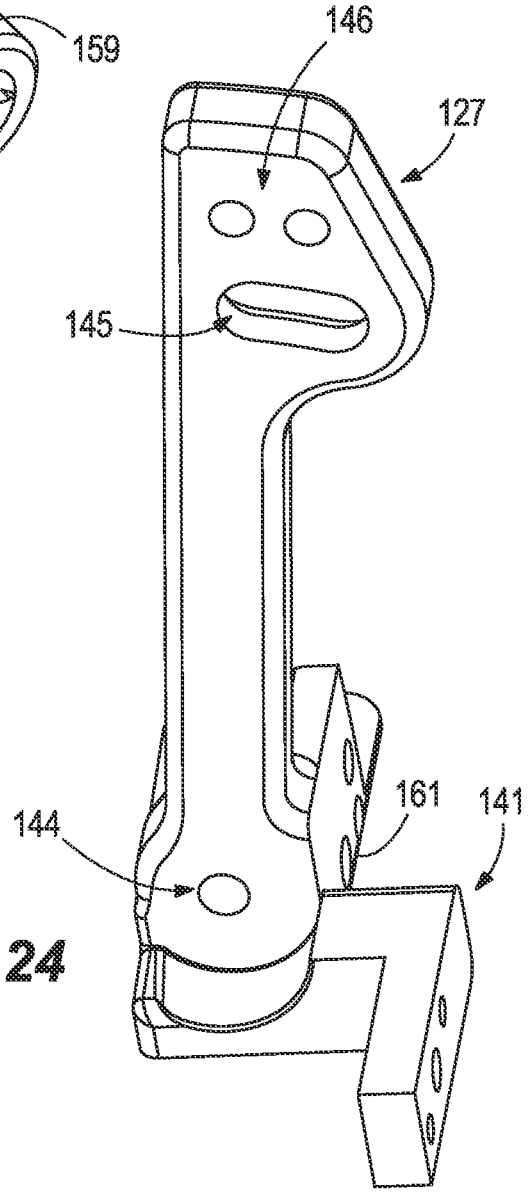
FIG. 24 shows toe view of FIG. 23.

For specific illustration, FIG. 23 illustrates the hosel body 122 forming at least three hosel body apertures 140 along an L-shaped protruding portion 141. Similarly, the lie arm 121 and more particularly the lie arm first end 123 forms two corresponding apertures 139 that's similarly sized to at least two hosel body apertures 140 of the three hosel body apertures 140. The third hosel body aperture has a larger diameter than the two similarly sized hosel body apertures. Each hosel body aperture 140 formed on the L-shaped protruding portion 141 has a corresponding aperture 139 formed at the lie arm first end 123 (see FIG. 11). The two similarly sized apertures 139,140 (can be referred to as "lie arm alignment aperture(s)" and "hosel body alignment aperture(s)) of the hosel body 122 and lie arm 121 are configured to receive pins (can also be referred to as "alignment pins") 142. These pins 142 (can be press fit) and help coordinate the alignment of the hosel body 122 and the lie arm 121 to one another. The lie arm aperture formed at the lie arm first end and the corresponding hosel body aperture that is larger in diameter than the other two apertures of the lie arm 121 and hosel body 122 are configured to receive a fastener (i.e. a screw, a bolt, etc.). The fastener applies an axial force that adjoins and/or clamps the lie arm 121 and the hosel body 122 together.

The plurality of alignment apertures 139,140 formed by the lie arm 121 and the hosel body 122 can or can not be threaded. The alignment aperture(s) 140 of the hosel body 122 and the corresponding alignment aperture(s) 139 of the lie arm comprises a diameter. The diameter of the alignment apertures 139, 140 can range between approximately 0.01 inch to approximately 1.0 inch. In many embodiments, the diameter of the alignment aperture 139, 140 can range between 0.01 inch-0.015 inch, 0.01 inch-0.02 inch, 0.02 inch-0.025 inch, 0.025 inch-0.030 inch, 0.030 inch-0.035 inch, 0.035 inch-0.040 inch, 0.040 inch-0.045 inch, 0.045 inch-0.050 inch, 0.050 inch-0.055 inch, 0.055 inch-0.060 inch, 0.060 inch-0.065 inch, 0.065 inch-0.070 inch, 0.070 inch-0.075 inch, 0.075 inch-0.080 inch, 0.080 inch-0.085 inch, 0.085 inch-0.090 inch, 0.090 inch-0.095 inch, 0.095 inch-0.100 inch. In many embodiments, the plurality of alignment apertures 139, 140 of the hosel body 122 and the lie arm 121 can be approximately 0.06 inches.

In some embodiments, the plurality of apertures 139,140 of the hosel body 122 and lie arm 121 that is configured to receive one or more pin(s) 142 can be referred to as a pair of alignment apertures. A pair of alignment apertures can be defined as an aperture formed on both the hosel body 122 and lie arm 121 that are configured to be aligned, affiliated, and/or concentric with each one another. In many embodiments, the hosel body 122 and lie arm 121 can combine to form one alignment pair apertures, two alignment pair apertures, three alignment pair apertures, four alignment pair apertures, five alignment pair apertures, six alignment pair apertures, seven alignment apertures, or eight alignment pair apertures.

Figure 15:
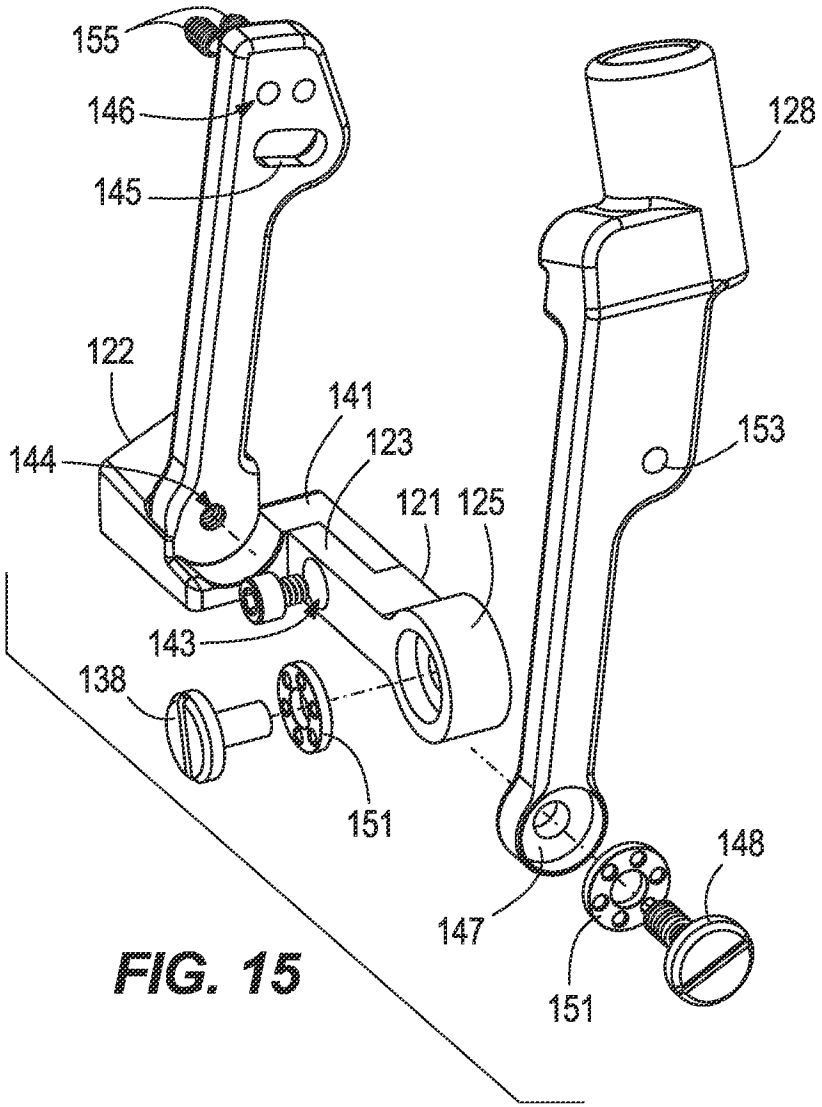
FIG. 15 shows another perspective view of the hosel of FIG. 14.
Figure 14:
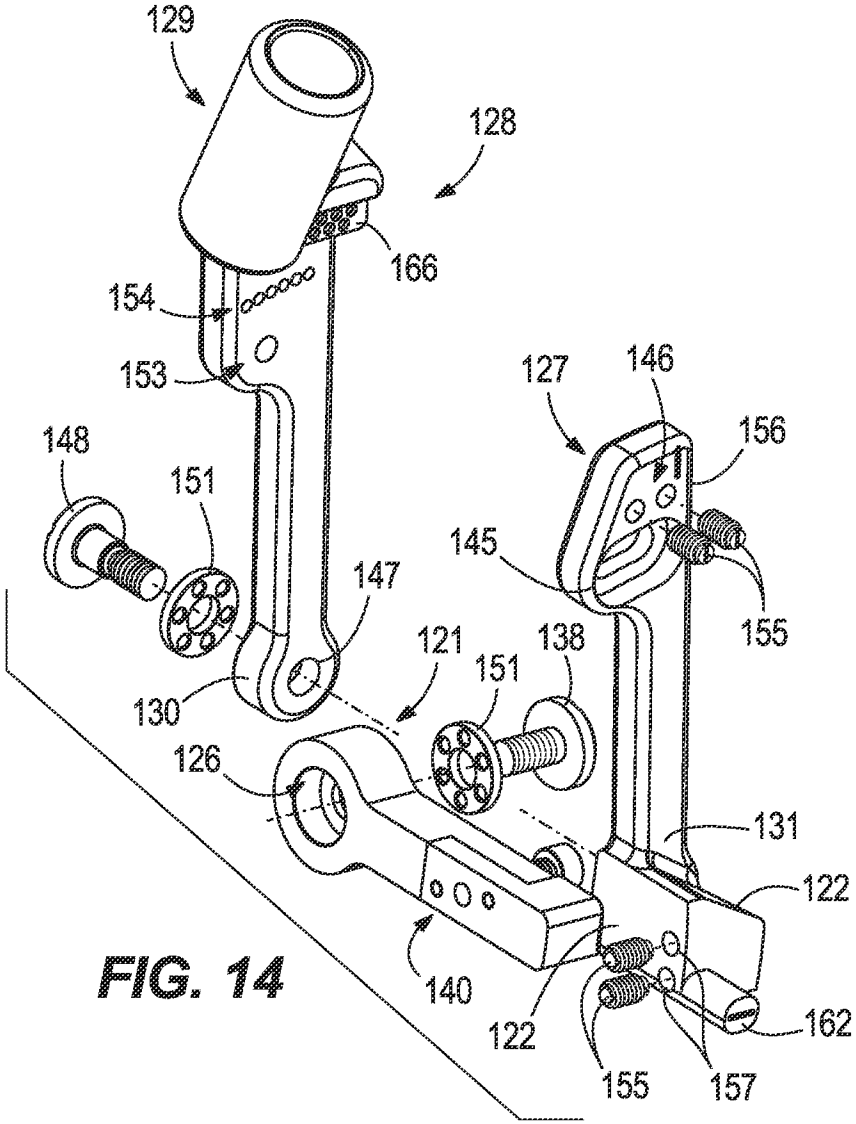
FIG. 14 shows a perspective exploded view of a hosel according to one embodiment.

As shown in FIGS. 14 and 15, the illustrated embodiment forms two pairs of alignment apertures such that each pair of alignment aperture is configured to receive an alignment pin 142. The alignment pin 142 can be pressed fit into one or more pairs of alignment apertures. This allows the hosel body 122 and the lie arm 121 to be quickly aligned with each other during the assembly process. One or more pair(s) of alignment apertures can be spaced from another pair of alignment apertures. A portion of the space formed between the pair of alignment apertures can further form a coupling aperture pair 143.

A coupling aperture pair 143 is defined herein as being the receiving aperture for a clamping component (i.e. a screw, a fastener, etc.) formed on both the lie arm 121 and hosel body 122. The coupling aperture pair 143 of the lie arm 121 and the hosel body 122 can be defined by a diameter. The diameter of the coupling aperture 143 formed on the lie arm 121 can or can not be equal to the diameter of the coupling aperture 143 formed on the hosel body 122.

The diameter of the coupling aperture 143 can range between 0.02 inch to approximately 0.5 inch. The diameter of the coupling aperture 143 can be between 0.02 inch to 0.04 inch, 0.04 inch-0.06 inch, 0.06 inch-0.08 inch, 0.08 inch-0.10 inch, 0.10 inch-0.12 inch, 0.12 inch-0.14 inch, 0.14 inch-0.16 inch, 0.16 inch-0.18 inch, 0.18 inch-0.20 inch, 0.20 inch-0.22 inch, 0.22 inch-0.24 inch, 0.24 inch-0.26 inch, 0.26 inch-0.28 inch, 0.28 inch-0.30 inch, 0.30 inch-0.32 inch, 0.32 inch-0.34 inch, 0.34 inch-0.36 inch, 0.36 inch-0.38 inch, 0.38 inch-0.40 inch, 0.40 inch-0.42 inch, 0.42 inch-0.44 inch, 0.44 inch-0.46 inch, 0.46 inch-0.48 inch, or 0.48 inch-0.50 inch.

With reference to FIGS. 15 and 23, the coupling aperture 143 of the hosel body 122 and the coupling aperture 143 of the lie arm 121 are of different diameters, but form a coupling aperture pair 143. In this exemplary embodiment, the diameter of the hosel body coupling aperture 143 is approximately 0.089 inches and the diameter of the lie arm coupling aperture 143 is approximately 0.203 inches. The lie arm coupling aperture 143 diameter is larger than the hosel body coupling aperture 143 simply due to the geometrical characteristics of the fastener.

The fastener geometry comprises a head portion, a shank portion, and a threaded portion. The head portion is larger than both the diameter of the shank portion, and the threaded portion. The threaded portion is configured to be received or threaded into the coupling aperture 143 of the hosel body 122 and the head portion is configured to abut the coupling aperture 143 of the lie arm 121. As the fastener becomes threaded into both the hosel body 122 and the lie arm 121, an axial force is exerted that clamps the respective components together. The head portion of the fastener geometry abuts the coupling aperture 143 of the lie arm 121, as the coupling aperture 143 of the lie arm 121 can be a countersunk or counterbore hole.

The hosel body 122 can further include an integrally connected ledge or flange (as illustrated by the L-shaped protruding portion 141). The ledge or flange can extend or protrude from any portion of the hosel body 122. In some embodiments, the ledge or flange extends proximal from a bottom portion of the hosel body 122 in a heel-to-toe direction. The bottom portion of the hosel body 122 is proximal to the sole 116. The top portion of the hosel body 122 is proximal to the top rail 115 of the putter type golf club head 100. The ledge or flange can comprise a curvilinear geometry, a parabolic geometry, a curved geometry, a rounded geometry, a L-shaped geometry, or geometric combinations thereof.

Adjustable Loft Angle Mechanism

Hosel Arm and Loft Arm Configuration and Arrangement

As discussed above, the putter-type club head can also comprise an adjustable loft mechanism 102. As generally described above, the adjustable loft angle mechanism comprises a hosel body 122, a hosel arm 127, and a loft arm 128. These components incorporate to incrementally adjust the loft angle of a putter-type golf club head in a front striking surface-to-rear surface direction (or rotating about the x-axis). Specifically, in many embodiments, the loft angle of the putter-type golf club head 100 is incrementally adjusted by the hosel arm 127 and loft arm 128 being rotatably or pivotably engaged to one another at the hosel arm second end 131 and the loft arm second end 130, respectively. The paragraphs below will describe in more detail the structure and arrangement of the components of the adjustable loft angle mechanism 102.

In some embodiments, the hosel arm 127 can integrally protrude from the hosel body 122 in a top rail 115-to-sole 116 direction. The height of the hosel arm 127 is less than the height of the loft arm 128. The hosel arm 127 is configured to reside beneath a portion of the hosel arm 127 and hidden or unnoticeable from a top view of the club head 100. Having the height of the hosel arm 127 less than the height of the loft arm 128 and hidden from a top view of the club head (at an address position) structurally resembles the hosel of a blade style putter, while providing a hosel with an adjustable fitting mechanism(s).

In this embodiment, the hosel arm 127 forms at least four hosel arm apertures 144-146 (a hosel arm lower mounting aperture 144, a hosel arm middle mounting aperture 145, and at least two hosel arm topmost mounting apertures 146). The hosel arm lower mounting aperture 144 is vertically spaced closer to the hosel body 122 than the hosel arm middle mounting aperture 145 and the hosel arm topmost mounting aperture 146. The hosel arm topmost mounting aperture 146 is spaced further vertically away from the hosel body 122 than the hosel arm middle mounting aperture 145. The hosel arm middle mounting aperture 145 is positioned between the hosel arm lower mounting aperture 144 and the two or more hosel arm topmost mounting apertures 146. The structure and function of each aperture of the hosel arm will be discussed in more detail below.

The loft arm 128 and the hosel arm 127 are adjacent to one another. In many embodiments, the loft arm 128 forms an aperture at the second end 130 of the loft arm 128 (i.e. loft arm lower aperture 147). The loft arm lower aperture 147 is configured to be aligned with the hosel arm lower mounting aperture 144 and adapted to receive a fastener. The fastener clamps the loft arm 128 and the hosel arm 127 together to further define a loft angle pivot point. Once the fastener is engaged to both the loft arm lower aperture 147 and the hosel arm lower mounting aperture 144, the fastener is not required to be removed to alter the loft angle of the golf club head. In some embodiments, the fastener is in the form of a shoulder bolt 148. Upon the shoulder bolt engaging the hosel arm lower mounting aperture 144 and the loft arm lower aperture 147, the arrangement of the shoulder bolt 148, hosel arm 127, and loft arm 128 defines a rotational surface for the loft arm 128 to rotate around in a front striking surface-to-rear direction (i.e. rotating about the x-axis). This type of rotation enables the loft angle of the club head to be altered.

Figure 25:
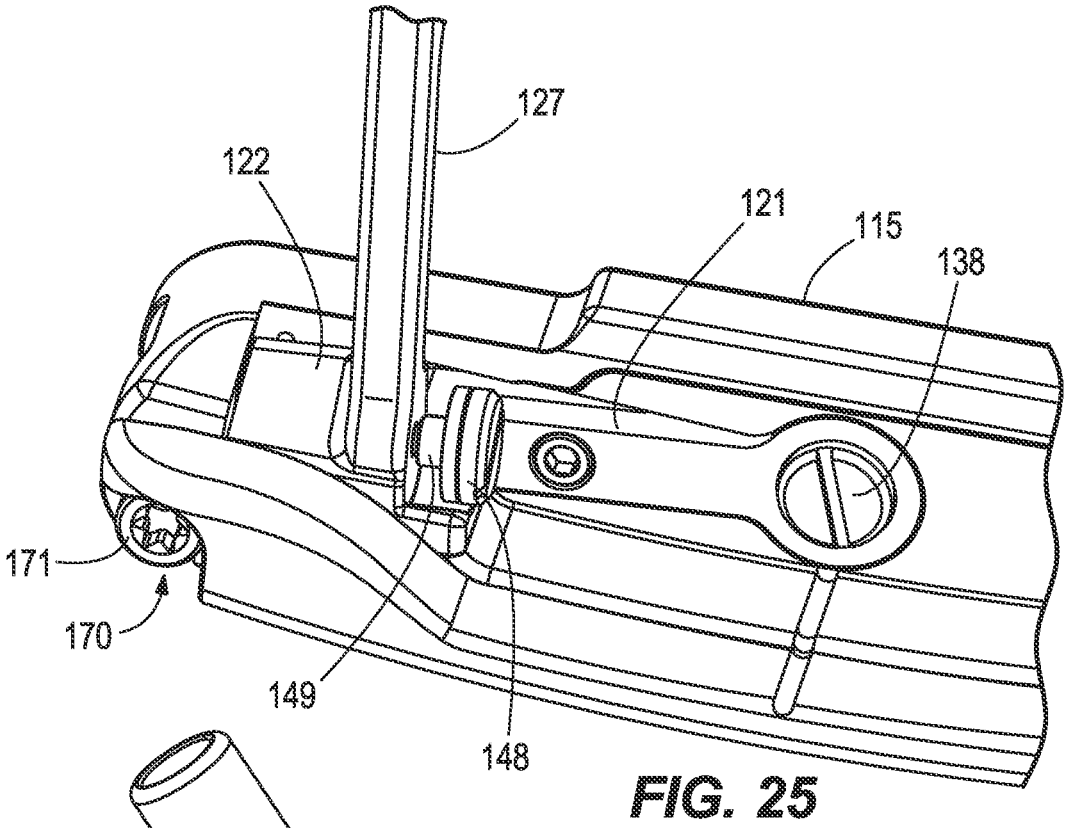
FIG. 25 shows a partial rear view of FIG. 9.

As the shoulder bolt 148 engages both the loft arm lower aperture 147 and the hosel arm lower mounting aperture 144, an outer surface of the loft arm lower aperture 147 rests upon the unthreaded shoulder bolt portion 149. The shoulder bolt 148, as illustrated in FIG. 25, has an unthreaded shoulder bolt portion 149 and a threaded shoulder bolt portion 150. The threaded shoulder bolt portion 150 threads into the hosel arm lower mounting aperture 144. The contact surface between the outer surface of the loft arm lower aperture 147 and the shoulder bolt 148 provides a pivot surface for the loft arm 127 to rotate about the x-axis (relative to the hosel arm) and incrementally alter the loft angle of the putter-type club head 100.

As described above, the loft arm lower aperture 147 can be in the form of a counterbore or countersunk hole. The counterbore or countersunk hole/aperture further provides an abutment surface for a bearing 151 to sit against. The bearing 151 enhances the ability to provide rotational or pivoting movement with respect to the hosel arm 127 and the loft arm 128, while simultaneously reducing the clamping stress induced by the shoulder bolt 148 and frictional forces caused by the loft arm 128 and hosel arm 127 contacting one another. The bearing 151 further reduces the contact/frictional forces induced by the loft arm 128 and a head of the shoulder bolt 148. Thereby, the shoulder bolt 148 clamps the hosel arm 127 and loft arm 128 together at a higher degree relative to a non-bearing assembly. Preferably, at each pivot surface or point of rotation, a bearing 151 is present for the above described advantages, although not required.

In addition to the loft arm second end 130 forming a loft arm lower aperture 147, the loft arm 128 further forms a loft arm middle aperture 153 vertically spaced from the loft arm lower aperture 147 in a top rail-to-sole direction. The loft arm middle aperture 153 can extend either entirely through the loft arm 128 or a portion thereof. The loft arm middle aperture 153 can be substantially cylindrical and defined by a diameter. The diameter of the loft arm middle aperture 153 can be approximately 0.107 inches. However, in other embodiments, the diameter of the loft arm middle aperture 153 can be between 0.02 and 0.75 inch.

In many embodiments, the loft arm middle aperture 153 is threaded. When the hosel arm middle mounting aperture 145 and the loft arm middle aperture 153 are aligned with each other, a fastener is configured to be inserted through the hosel arm middle mounting aperture 145 and threadedly engage the threads of the loft arm middle aperture 153. This type of arrangement further reinforces and clamps the hosel arm 127 and the loft arm 128 together. Unlike the other fastener that clamps the loft arm 128 and hosel arm 127 together at the loft arm lower aperture 147 and the hosel arm lower mounting aperture 144, the fastener needs to be unthreaded from the loft arm middle aperture 153 or loosened to alter the loft angle of the golf club head 100. The hosel arm middle mounting aperture 145 is larger than the loft arm middle aperture 153. This allows the hosel arm middle mounting aperture 153 to account for various loft angle adjustment positions, while still permitting clamping of the hosel arm 127 and loft arm together 128 (See FIG. 29 and FIG. 30).

In many embodiments, the hosel arm middle mounting aperture 145 can be configured to be larger than the major diameter of the fastener. Further, the hosel arm middle mounting aperture 145 can be sized to account for the most extreme loft angle adjustment positions (See FIG. 29 and FIG. 30).

The loft arm 128 further forms a plurality of loft arm top apertures 154 positioned closer to the first end 129 of the loft arm than the second end 130 of the loft arm 128. The plurality of loft arm top apertures 154 can be in the form of any shape and preferably does not need to extend entirely through the body of the loft arm 128. The plurality of loft arm top apertures 154 can be any shape, including, but not limited to, conical, pill shaped, cylindrical, pyramidal, funnel-shaped, pointed, and/or tapered geometries. It is preferred that the loft arm top apertures 154 are conical or pill shaped. This type of geometry enables the loft arm top apertures 154 to quickly engage and disengage a plunger 155 (see FIG. 28). The loft arm top apertures 154 further aid in precisely altering the loft angle of the club head, which will be discussed in more detail below. Each of the loft arm top apertures 154 are spaced/positioned from one another, such that there is a space present between a pair of loft arm top apertures 154. In this particular embodiment, the plurality of top arm apertures are spaced from one another in intervals of degrees.

Having the geometry of the loft arm top apertures 154 be pill-shaped or conical increases the surface area of the loft arm top apertures 154 (relative to a circular aperture). As more surface area is present, the tolerance stacking between the loft arm top apertures 154, hosel arm topmost mounting apertures 146, and plungers 155 are not required to be as tight or precise, which reduces the required machining tolerances, machining time, and cost.

Figure 27:
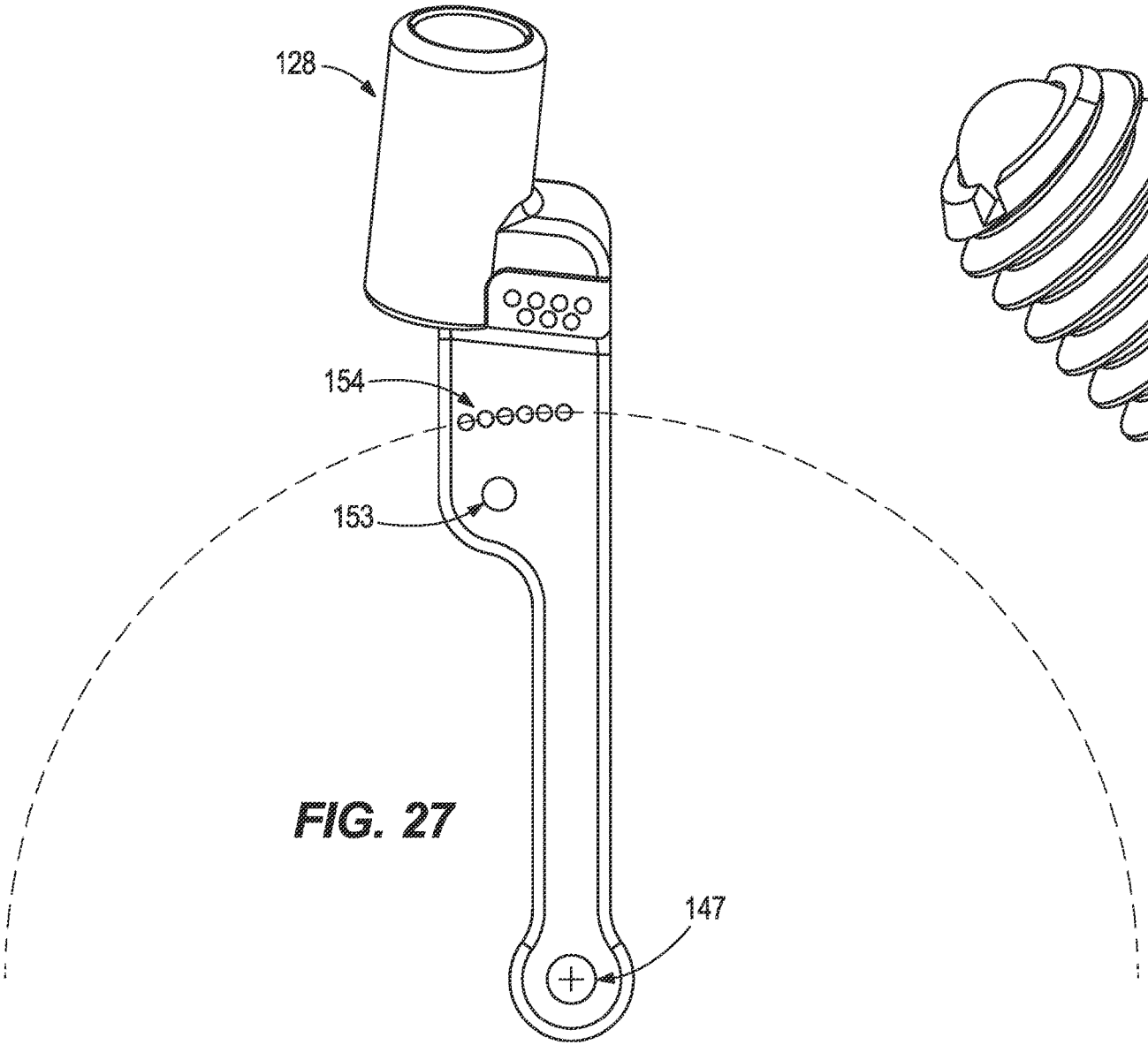
FIG. 27 shows heel view of a loft arm according to one embodiment.

Specifically, in reference to FIG. 27, the plurality of loft arm top apertures 154 are spaced from one another in intervals of two degrees. However, in other embodiments, the plurality of loft arm top apertures 154 can be spaced from one another by three degrees, four degrees, five degrees, six degrees, seven degrees, eight degrees, nine degrees, ten degrees, eleven degrees, twelve degrees, thirteen degrees, fourteen degrees, fifteen degrees, sixteen degrees, seventeen degrees, eighteen degrees, ninety degrees, or twenty degrees. The degree spacing distance is in reference to an imaginary circle with a center at the loft arm lower aperture 147 and extends through the center of each of the plurality of loft arm top apertures 154 (See FIG. 27).

As illustrated in FIG. 14, the two or more hosel arm topmost mounting apertures 146 are formed proximal to the first end 156 of the hosel arm 127. Having two or more apertures (hosel arm topmost mounting apertures 146)

formed at the first end 156 of the hosel arm 127, as well as, having each hosel arm topmost mounting aperture 146 configured to receive a plunger 155 aids in precisely adjusting the loft angle of the golf club head 100. The two or more hosel arm topmost mounting apertures 146 are preferably threaded to receive one or more plungers 155 (i.e. a first plunger in a first hosel arm topmost mounting apertures and second plunger in a second hosel arm topmost mounting apertures) in each aperture. In alternative embodiments, one or more plungers 155 can be press fit into one or more of the hosel arm topmost mounting apertures 146, instead of threadably engaged.

In many embodiments, the plungers 155 can be in the form of a ball plunger. The ball plunger comprises a hollow threaded body, a spring positioned inside the hollow threaded body, and a ball coupled to the spring. The ball plunger is configured to engage and disengage the plurality of loft arm top apertures 154. This type of arrangement between the ball plunger 155, the plurality of loft arm top apertures 154, and the hosel arm topmost mounting apertures 146 provides feedback to the user when the loft angle has been adjusted and more precisely adjusts the loft angle to a certain predetermined position.

For example, in reference to FIG. 14, the body of the ball plunger is adapted to threadably engage each of the hosel arm topmost mounting apertures 146. With continued reference to FIG. 14, the hosel arm 127 comprises two hosel arm topmost mounting apertures 146. The two hosel arm topmost mounting apertures 146 are threaded and each hosel arm topmost mounting aperture 146 is configured to receive the threaded body of the ball plunger 155. When the ball plunger 155 is threadably engaged to the hosel arm topmost mounting aperture 146, the ball of the ball plunger 155 is configured to contact the loft arm 128, and more specifically engage with one of the plurality of loft arm top apertures 154. At any given time, the first ball plunger 155 is configured to engage one of the plurality of loft arm top apertures 154 and the second ball plunger 155 is configured to reside in the space between a pair of loft arm top apertures 154. When a fitter or user (not shown) wants to alter the loft angle, the fitter needs to unfasten/unthread the fastener from the loft arm middle aperture 153 to reduce the clamping force between the hosel arm and loft arm. This type of arrangement between the ball plunger 155, the plurality of loft arm top apertures 154, and the hosel arm topmost mounting apertures 146 provides feedback to the user when the loft angle has been adjusted and more precisely adjusts the loft angle to a certain predetermined position.

Specifically, the hosel arm topmost mounting apertures 146 are spaced from one another in intervals of five degrees. However, in other embodiments, the plurality of hosel arm topmost mounting apertures 146 can be spaced from one another by one degree, two degrees, three degrees, four degrees, five degrees, six degrees, seven degrees, eight degrees, nine degrees, ten degrees, eleven degrees, twelve degrees, thirteen degrees, fourteen degrees, fifteen degrees, sixteen degrees, seventeen degrees, eighteen degrees, ninety degrees, or twenty degrees. The degree spacing distance is in reference to an imaginary circle with a center at the hosel arm lower mounting aperture 144 and extending through the center of each of the plurality of hosel arm topmost mounting apertures 146.

Figure 29:
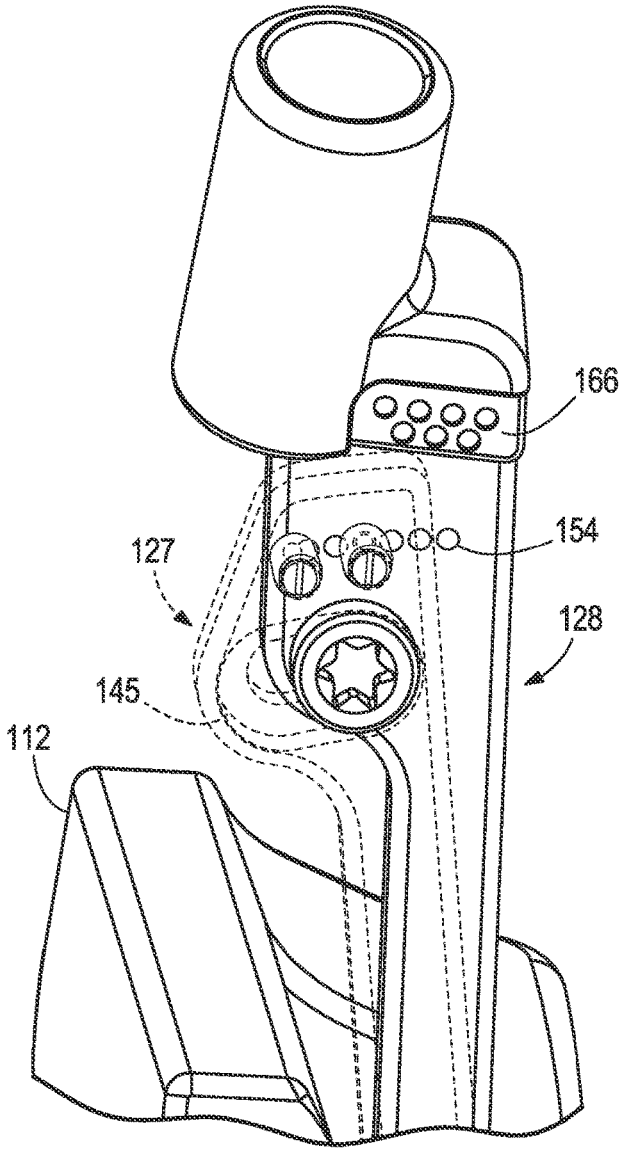
FIG. 29 shows a partial view of the adjustable loft angle mechanism in a first configuration according to one embodiment.
Figure 30:
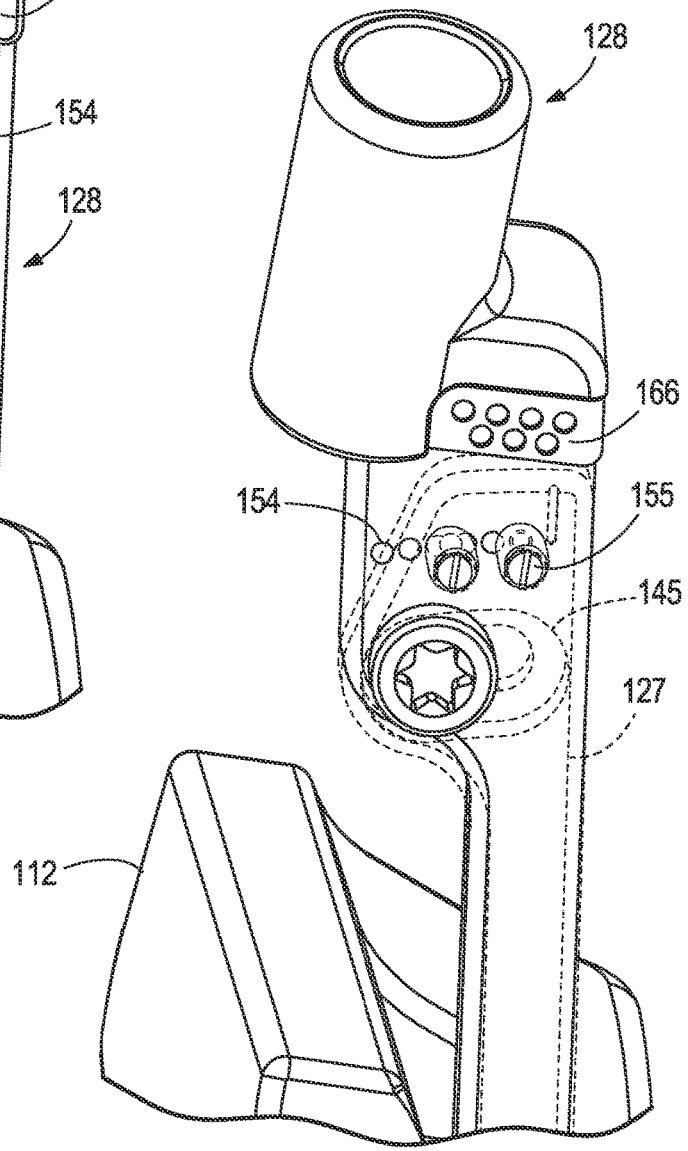
FIG. 30 shows a partial view of the adjustable loft angle mechanism in a second configuration according to one embodiment.

Upon the loft arm 128 and hosel arm 127 being uncoupled from each other (unfastening the fastener from the hosel arm middle mounting aperture 145 and loft arm middle aperture 153), the ball plungers 155 can be configured to be repositionably engaged within one of the plurality of top apertures 154 of the loft arm 128. For way of illustration, FIG. 29 illustrates a golf club head 100 in a first loft configuration (i.e. the first ball plunger 155 engaged within one of the plurality of loft arm top apertures 154 and the second ball plunger 155 engaged within the space between two adjacent loft arm top apertures 154. FIG. 30 illustrates a golf club head 100 in a second loft configuration (relative to the first loft configuration).

When comparing FIGS. 29 and 30, it can be seen that to change the loft angle of the putter-type golf club head 100, the hosel arm 127 and the loft arm 128 pivot with respect to one another at the hosel arm second end 131 and the loft arm second end 130, respectively and upon rotation the ball plungers 155 are able to disengage and move from its current position to another position (i.e. space between two loft arm top apertures or engaged in another loft arm aperture 154). This type of engagement and disengagement of the ball plungers 155 within the loft arm top apertures 154 provides feedback to the user when the loft angle has been adjusted, more precisely adjusts the loft angle to a certain predetermined position, and provides a temporary "locked" position of the hosel arm 127 to the loft arm 128. This temporary locked position ensures the fitter (or user) that the loft angle of the putter-type club head 100 will not be inadvertently altered when reclamping the hosel arm 127 to the loft arm 128.

Adjustable Lie Angle Mechanism—Hosel Body/Plungers Interaction

Figure 31:
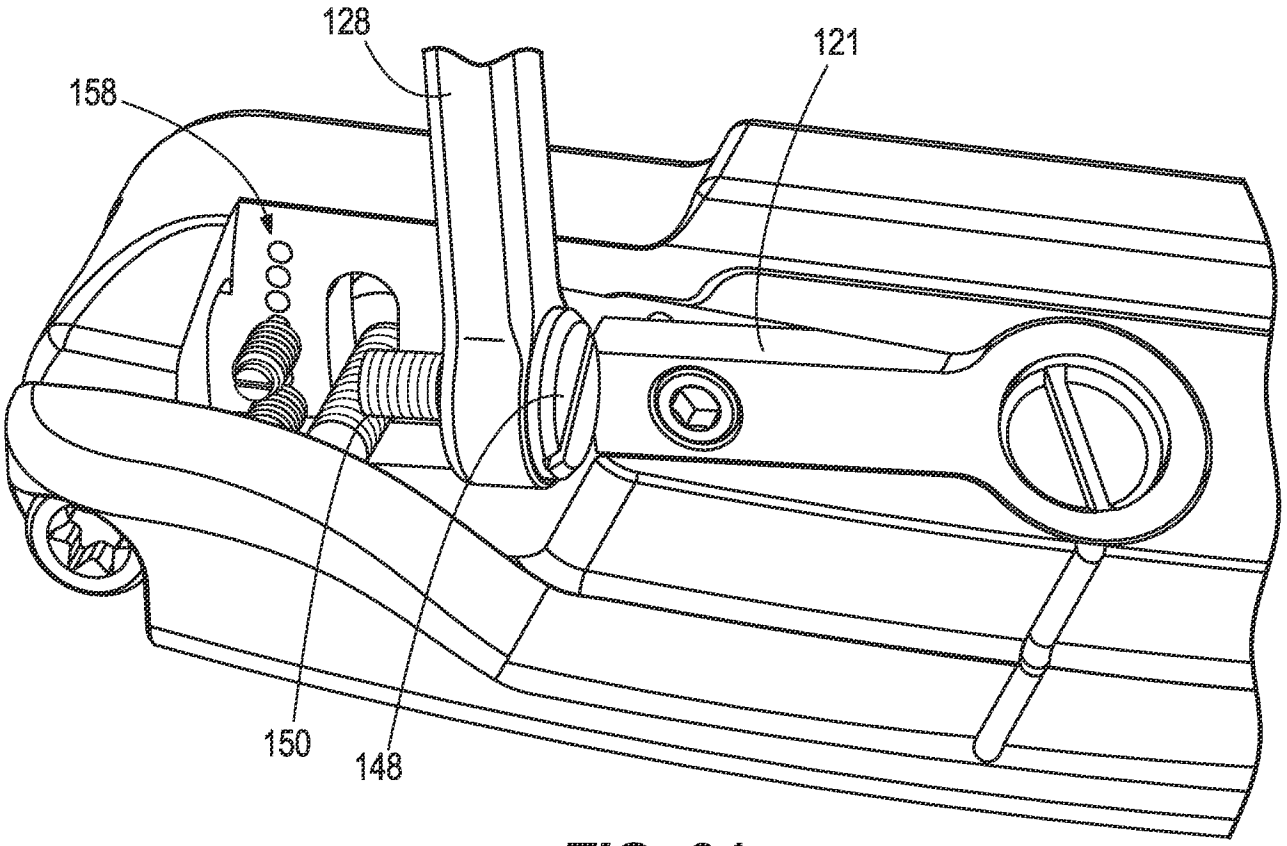
FIG. 31 shows a partial view of the putter-type golf club head according to one embodiment.

As described above, the adjustable lie angle mechanism further comprises plungers/apertures. Similarly, to the description above, the hosel body 122 forms at least two apertures (i.e. second set of hosel body apertures 157) towards the heel end 114 of the putter-type golf club head 100, on the other side of the L-shaped protruding portion 141, or distal from the L-shaped protrusion 141 (see FIG. 23). Each of the second set of hosel body apertures 157 are configured to receive a ball plunger 155. One and only one ball plunger 155 (at any given time) is configured to be inserted into a plurality of catches 158 formed by the rear surface 118 of the club head body proximal to the heel end 114 of the golf club head 100 (as illustrated by FIG. 31). The ball plungers 155 can be threadably engaged or press fit into the second set of hosel body apertures 157.

The plurality of catches 158 are recesses formed in rear surface 118 of the club head body 112. The one or more ball plungers 155 can be threadably engaged to the second set of hosel body apertures 157. The plurality of catches 158 are similar in function and structure with respect to the arrangement of the ball plungers 155, loft arm top aperture 154, and hosel arm topmost mounting apertures 146 described above. The plurality of catches are generally spaced from each other in a top rail-to-sole direction.

Figure 32:
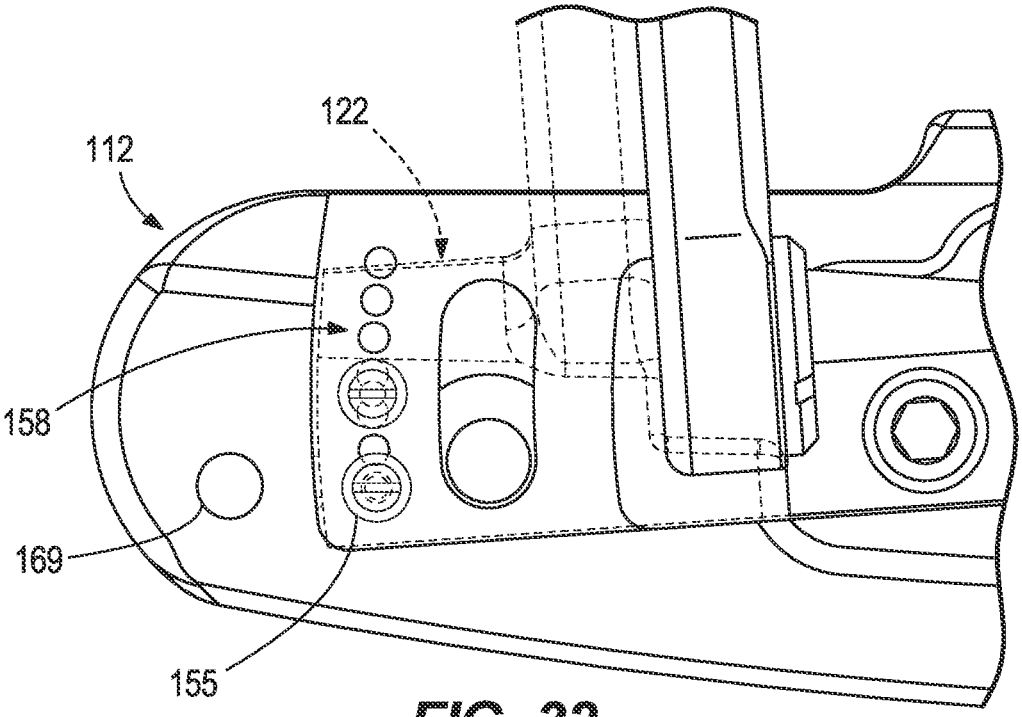
FIG. 32 shows a partial rear view of the adjustable lie angle mechanism in a first configuration according to one embodiment.
Figure 33:
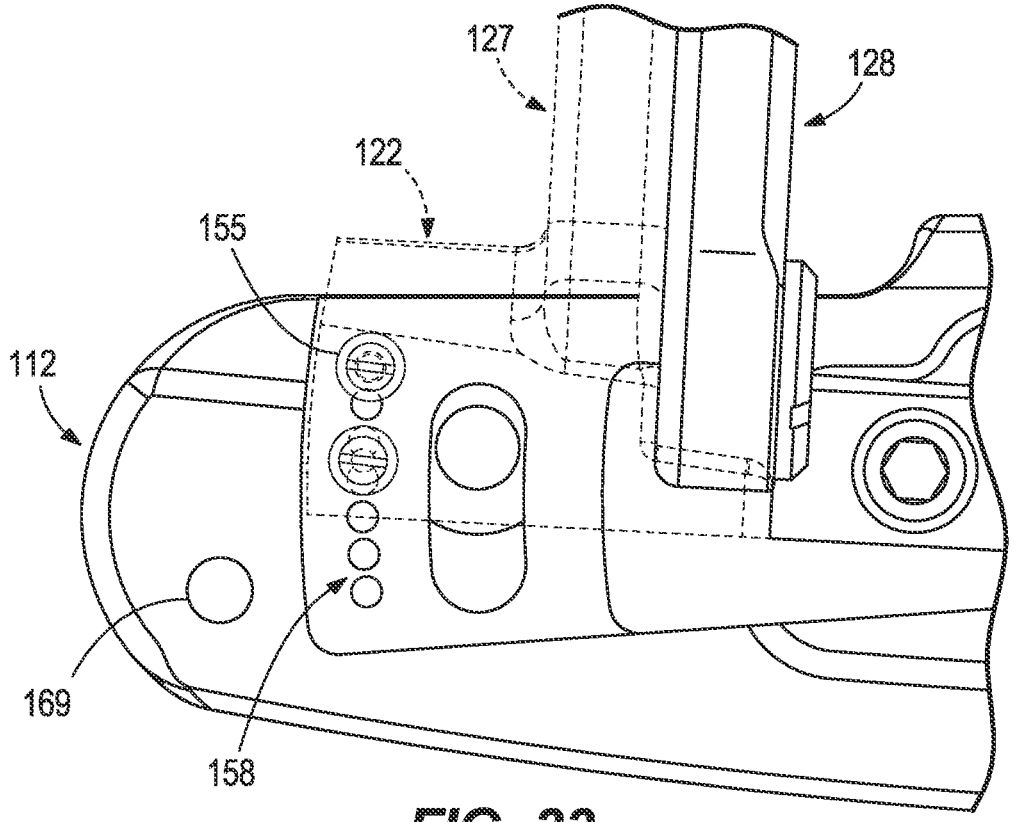
FIG. 33 shows a partial rear view of the adjustable lie angle mechanism in a second configuration according to one embodiment.
Figure 34:
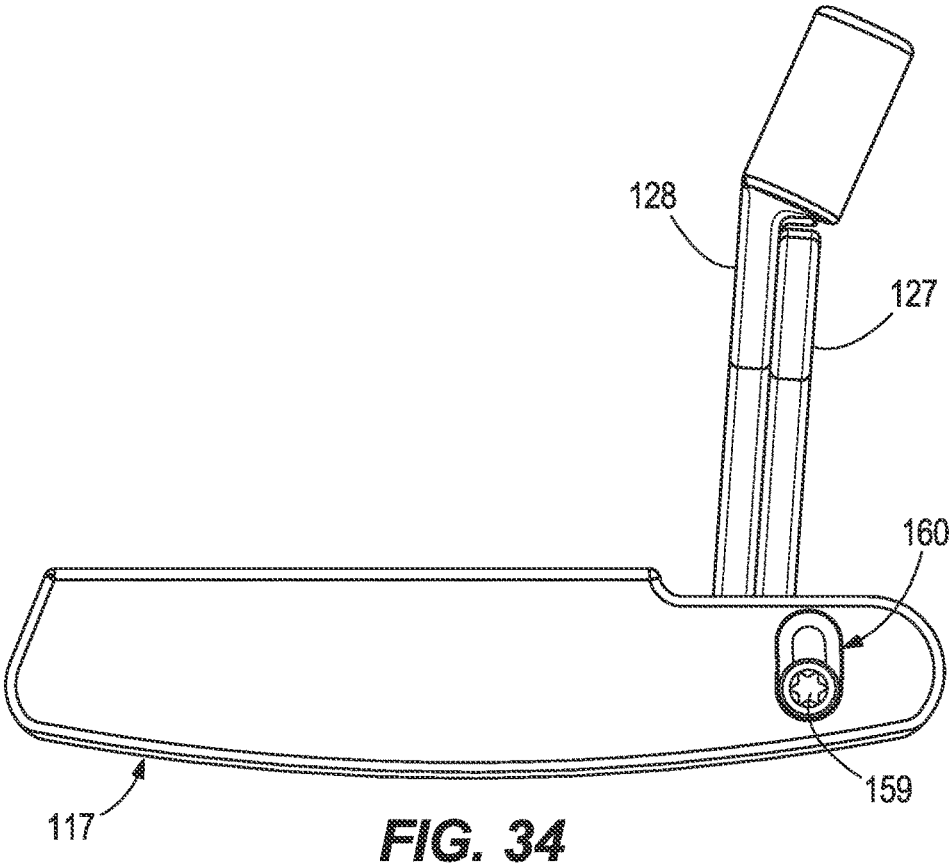
FIG. 34 shows an assembled front view of the putter-type golf club head of FIG. 1.

Upon a strike face fastener 159 being uncoupled from the hosel body 122 (unthreading the strikeface fastener 159 from the hosel body 122), the ball plungers 155 can be configured to be repositionably engaged within one of the plurality of catches 158 of the rear surface 118 of the clubhead body 112. For way of illustration, FIG. 32 illustrates a golf club head 100 in a first lie configuration (i.e. first ball plunger 155 engaged within one of the plurality of catches 158 formed in the rear surface 118 of the club head body 112 and a second ball plunger 155 engaged within the space between two adjacent catches 158 formed in the clubhead body 112. FIG. 33 illustrates a golf club head in a second lie configuration (relative to the first lie configuration). When comparing FIGS. 32 and 33, it can be seen that to change the lie angle of the putter-type golf club head 100, the lie arm 121 rotates about the post 120 and upon rotation, the first and second ball plungers 155 either (1) disengage and move away from its current position to another position (i.e. space between adjacent catches 158 or engage another catch 158 formed in the rear surface 118 of the clubhead body 112). The ball plungers 155 moving in and out of the catches 158 provide feedback to the fitter and more accurately adjusts the lie angle of the putter-type golf club head 100. Further, having a ball plunger temporarily engaging one of the plurality of catches 158 creates a temporary locked position. This temporary locked position ensures the fitter (or user) that the lie angle of the putter-type club head 100 will not be inadvertently altered, when reclamping the strike face fastener 159 to the hosel body 122.

The front striking surface 117 forms a front striking surface aperture 160. The front striking surface aperture is proximal to the heel end 114 of the putter-type golf club head 100. The front striking surface aperture 160 can be any geometry, including an oval. In many embodiments, the geometry of the front striking surface aperture 160 can be round, circular, cylindrical, rectangular, square, polygonal, curvilinear, or combinations thereof. The front striking surface aperture 160 can be in the form of a counterbore or countersunk hole. The front striking surface aperture 160 can extend entirely through the front striking surface 117 or a portion thereof.

The strike face aperture 160 is aligned with a third set of hosel body aperture(s) 161 formed on the rear surface 118 of the putter-type golf club head 100. The third set of hosel body aperture(s) 161 can be threaded and proximal to the second set of hosel body apertures 157. The strike face fastener 159 can be configured to be inserted through both the strike face aperture 160 and threadably engage the third set of hosel body aperture(s) 161. This type of arrangement of the strike face aperture 160, the third set of hosel body aperture(s) 161, and the strike face fastener 159 mechanically couples or clamps the hosel body 122 to the rear surface 118 of the putter-type golf club head 100.

Insertion of the Hosel to the Club Head Body

In some embodiments, the hosel tab 162 can not be present, rather, a fastener can be configured to engage a double recess aperture 163 and become coupled to the hosel body 122 by means of mechanical engagement (i.e. via threads). In other embodiments, if the hosel tab 162 extends from the hosel body 122, then the hosel needs to be inserted into the second deeper recess 134 at a distance spaced from the heel end 114 of the putter-type golf club head 100 and then shift, slide, or translate the hosel body 122 towards the heel end 114 of the club head until the hosel tab sits flush with double recess aperture 163. This creates the aforementioned puzzle-locking geometry. On the hand, if the hosel tab 162 is not present and rather the fastener engages both the double recess aperture 163 and the hosel body 122, the hosel body 122 can be directly inserted at the extreme most heel side end of the second deeper recess 134.

For further description, in embodiments where the hosel tab 162 is present, the hosel body 122 can be spaced from the extreme heel side boundary of the second deeper recess 134 by at least the length of the hosel tab (measured in a heel-to-toe direction) 162. As directly inserting the hosel body 122 to the heel side boundary of the second deeper recess 134 would have the hosel tab 162 contacting a portion of the club head body 112, thereby restricting insertion of the hosel body 122 into the second deeper recess 134.

Loft & Lie Angle Visual Indicators

To help a fitter (not shown) more quickly and knowingly adjust the lie angle of the putter type golf club head 100, the double recess aperture 163 can be formed in the heel end 114 of the putter-type golf club head 100. The double recess aperture 163 can have a first portion and a second portion. The first portion of the double recess aperture 163 can be defined as having a portion of the aperture extending entirely through a heel end 114 of the club head body 112. Thereby, forming a void. The second portion of the double recess aperture 163 can define a cavity (i.e. extending through a portion of the heel end 114 of the putter-type golf club head 100 and not entirely through the heel end 114), as shown in the illustrative embodiment of FIG. 35.

In many embodiments, the hosel tab 162 can have a groove or slot 164 formed at the end of the hosel tab 162. The groove or slot 164 can extend generally in a front striking surface-to rear direction. Additionally, in many embodiments, the cavity or second portion of the double recess aperture 163 extending through a portion of the heel end 114 of the putter-type golf club head 100 can include a plurality of lie angle alignment markers 165. In combination with the groove 164 disposed on the hosel tab 162 and the plurality of lie angle alignment markers 165 formed into or extending from a surface of the cavity, a visual aid is formed. The visual aid enables the fitter to quickly gage the current lie angle the putter-type golf club head and easily adjust the putter-type golf club head 100 to another desired lie angle configuration.

In some embodiment, a lie badge (not shown) can be attached to the cavity or the second portion of the double recess aperture not extending entirely through the heel end of the putter-type golf club head. The lie badge can form a plurality of lie angle alignment markers 165 that are either formed into or protrude from a surface of the lie badge. As will be discussed below, the plurality of lie angle alignment markers 165 represent different lie angle configurations. Each of the plurality of lie angle markers 165 can be different colors from one another for easily identifying the current lie angle of the putter-type golf club head. The width of the lie badge can be between approximately 0.07 inch to approximately 1.4 inches. In some embodiments, the lie badge can be approximately 0.63 inch.

The plurality of lie angle alignment markers 165 are configured to represent different lie angles. For example, one lie angle adjustment marker can define one lie angle configuration, another lie angle adjustment marker can define another lie angle configuration, etc. In many embodiments, the plurality of lie angle alignment markers 165 can be in one or more rows, one or more columns, one or more groups, or one or more sets. In other embodiments, there can be two or more, three or more, four or more, five or more, six or more, seven or more, eight or more, nine or more, ten or more, eleven or more, twelve or more, thirteen or more, fourteen or more, fifteen or more, sixteen or more, seventeen or more, eighteen or more, nineteen or more, or twenty or more lie angle alignment markers 165.

The spacing or distance between lie angle alignment markers 165 can differ from another group of alignment markers or can be equally spaced between lie angle alignment markers 165. The spacing distance between lie angle alignment markers can have a non-constant spacing distance between alignment markers to create a wider span or range of lie angle positions.

Figure 20:
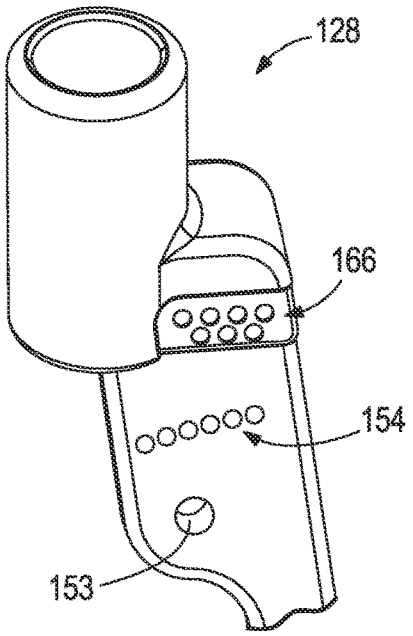
FIG. 20 shows a partial view of the loft arm according to one embodiment.
Figure 21:
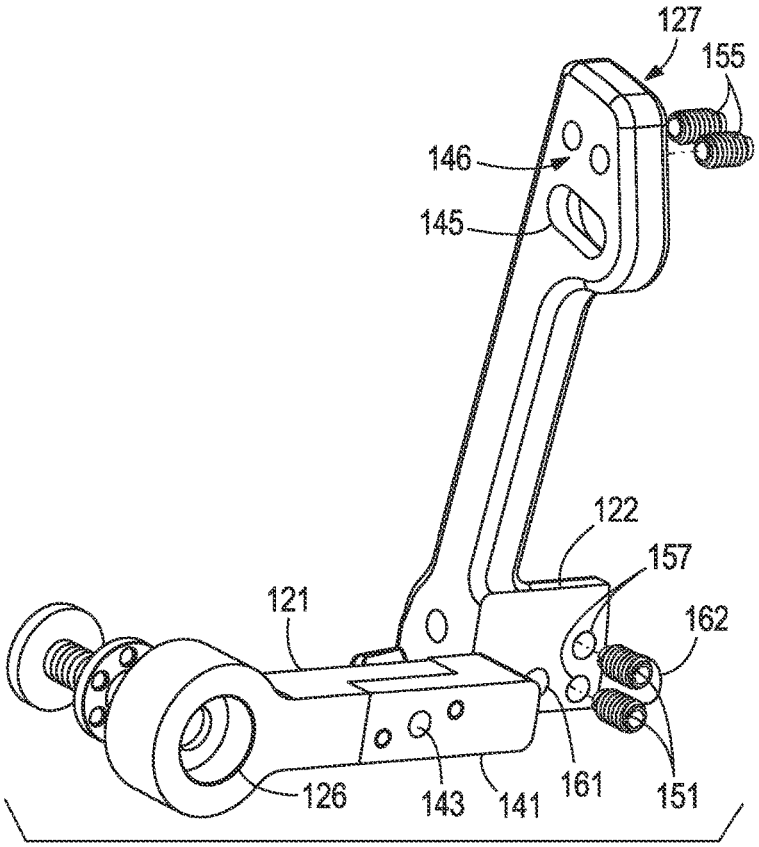
FIG. 21 shows another perspective view of FIG. 18.
Figure 22:
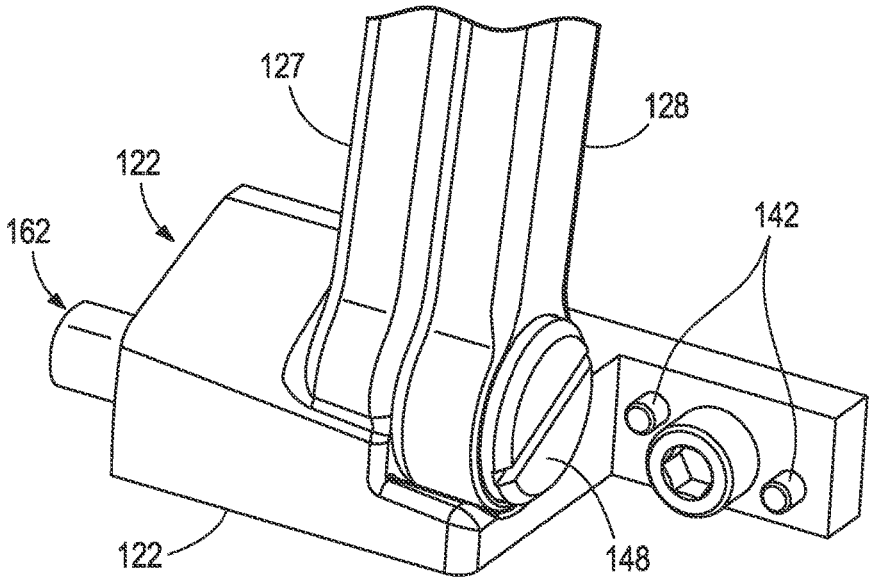
FIG. 22 shows a close-up rear view of FIG. 18.

With specific reference to FIG. 20, a plurality of loft angle alignment markers 166 can be formed proximal to the first end 129 of the loft arm 128. The plurality of loft angle alignment markers 166 formed at the first end 129 of the loft arm 128 can be in the form of indentations or protrusions. In many embodiments, the plurality of loft angle alignment markers 166 can be in one or more rows, one or more columns, one or more groups, or one or more sets. In other embodiments, there can be two or more, three or more, four or more, five or more, six or more, seven or more, eight or more, nine or more, ten or more, eleven or more, twelve or more, thirteen or more, fourteen or more, fifteen or more, sixteen or more, seventeen or more, eighteen or more, nineteen or more, or twenty or more loft angle alignment markers 166.

The spacing or distance between loft angle alignment markers 166 can differ from another group of loft angle alignment markers 166 or be equally spaced between loft angle alignment markers 166. The spacing distance can have a non-constant spacing distance between loft angle alignment markers 166 to create a wider span or range of loft angle positions.

In another embodiment, a loft badge (not shown) can be attached to the first end 129 of the loft arm 128. The loft badge can form a plurality of loft angle alignment markers 166 that are either formed into or protrude from a surface of the loft badge. As will be discussed below, the plurality of loft angle alignment makers represents different loft angle configurations. Each of the plurality of loft angle alignment markers 166 can be different colors from one another for easily identifying the current loft angle of the putter-type golf club head 100. The width of the loft badge can range between approximately 0.07 inch to approximately 1.4 inches. In some embodiments, the loft badge can be approximately 0.63 inch.

In many embodiments, the first end 156 of the hosel arm 127 can have a groove, slot, or protrusion formed thereon. The groove, slot, or protrusion formed proximal to the first end 156 of the hosel arm 127 can be any shape, including a rectangle. This groove, slot, or protrusion signifies the current loft angle build of the putter type golf club head 100 upon coupling to the loft arm 128. Further, in many embodiments, the groove, slot or protrusion can extend generally in a top rail-to-sole direction. In combination with the groove, slot, or protrusion disposed at the first end 156 of the hosel arm 127 and the plurality of loft angle alignment markers 166 formed into or extending from the first end 129 of the loft arm 128, a loft angle visual aid can be formed. The visual aid enables the fitter to quickly gage the current loft angle of the putter-type golf club head 100 and easily adjust the putter-type golf club head to another desired loft angle. As discussed above, the cub head can further comprise an adjustable head mass mechanism.

Adjustable Head Mass Mechanism

The adjustable fitting mechanism permits the ability to incrementally adjust the head mass of the club head. In other embodiments, the golf club head can not have an adjustable head mass fitting mechanism 103. The back surface 119 of the putter-type golf club head 100 defines a rear ballast 168 detachably engaged to the club head body 112 via fasteners/apertures (see FIG. 16). In alternative embodiments, the adjustable head mass mechanism 103 can engage and disengage the club head body 112 through magnets, rather than fasteners.

Figure 16:
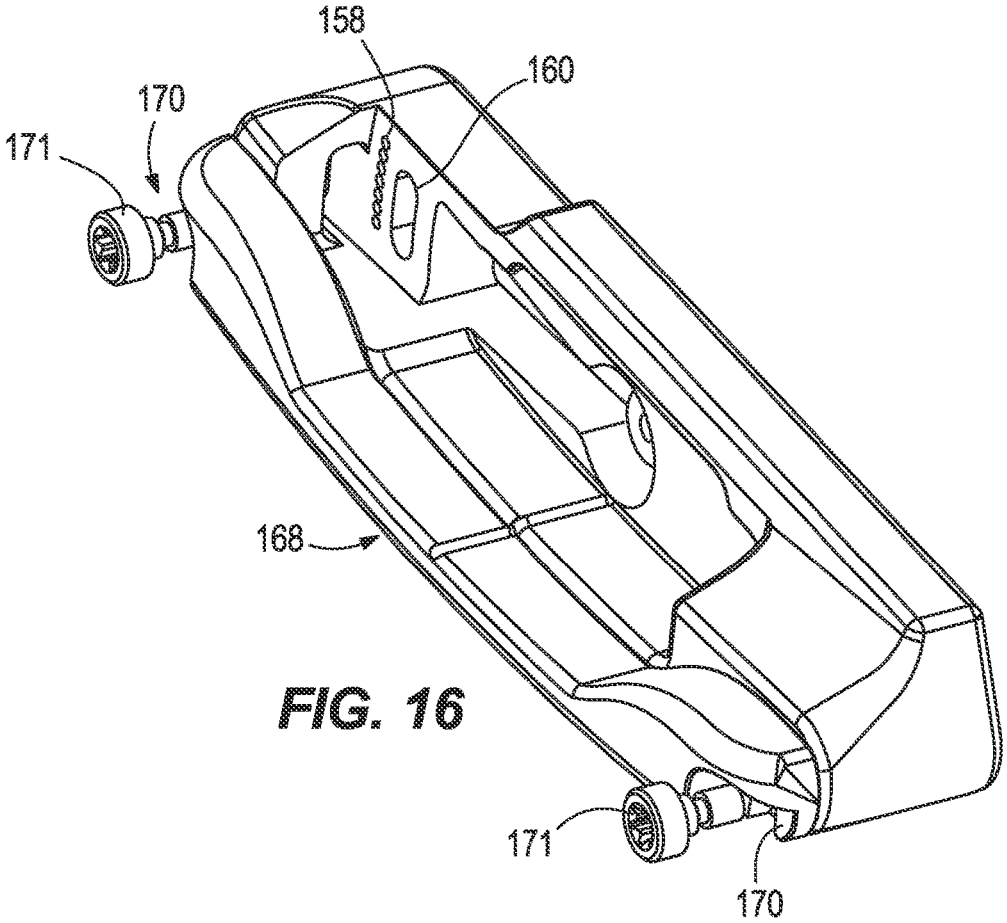
FIG. 16 shows a toe perspective view of the putter-type golf club head according to one embodiment.
Figure 17:
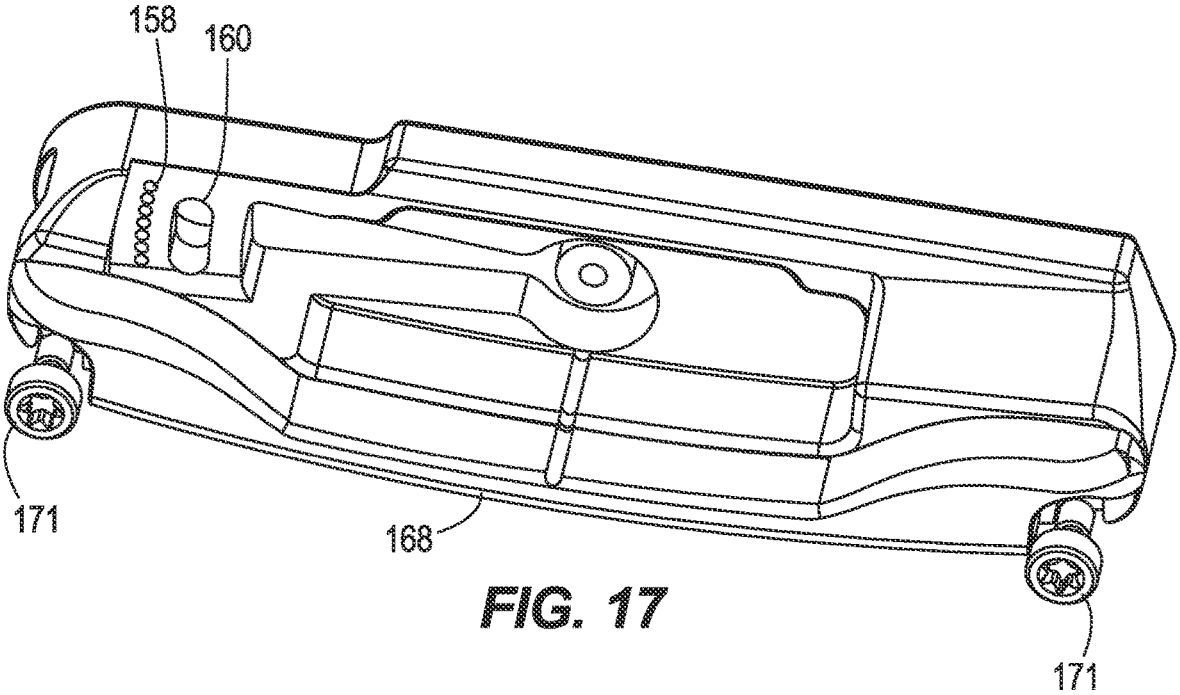
FIG. 17 shows a rear perspective view of the putter-type golf club head of FIG. 16.
Figure 18:
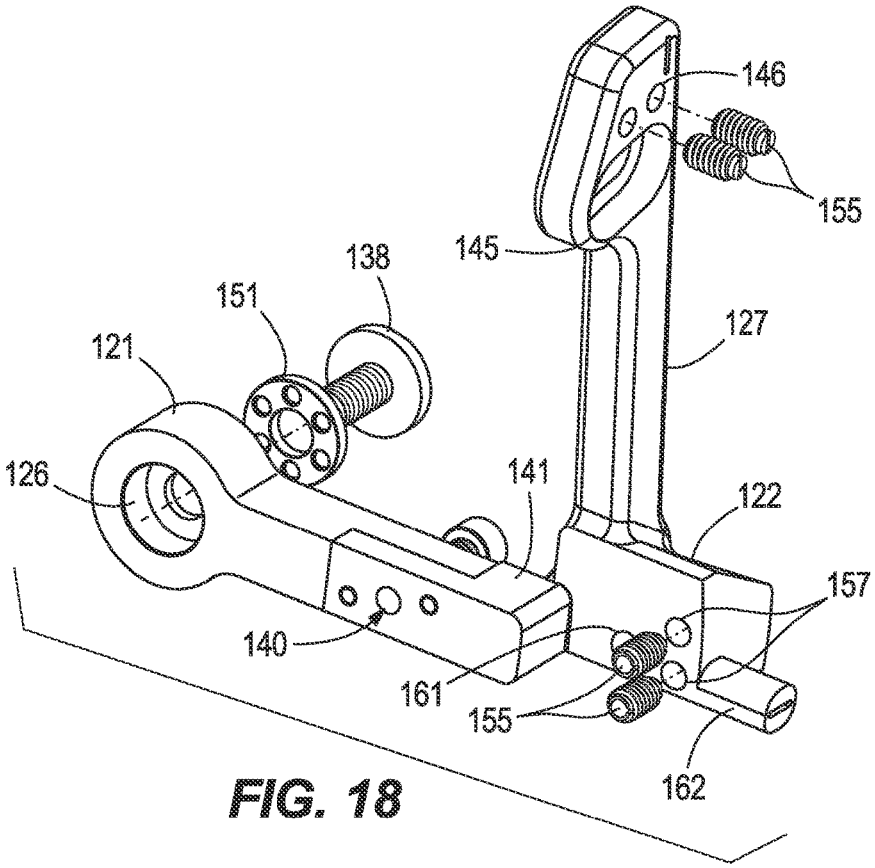
FIG. 18 shows a front view of the hosel according to one embodiment.
Figure 26:
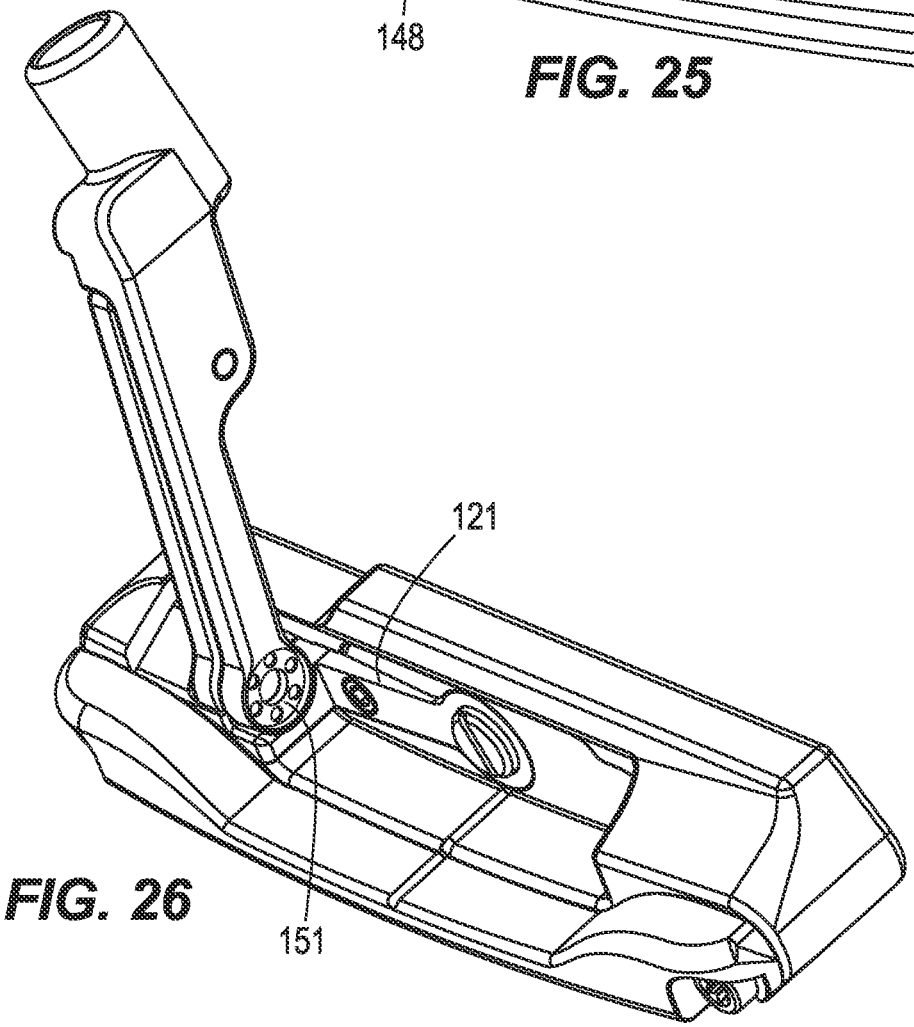
FIG. 26 shows a perspective toe view of FIG. 9.
Figure 28:
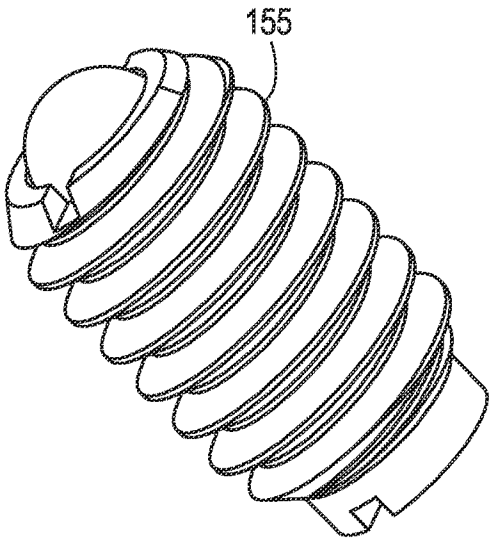
FIG. 28 shows a perspective view of a plunger according to one embodiment.

In the illustrated embodiment of FIGS. 12, 16, and 26, the back surface 119 of the putter type golf club head 100 forms at least two back surface apertures 169. The first back-surface aperture 169 is positioned proximal to the heel end 114 and the second back surface aperture 169 is positioned proximal to the toe end 113. Each back-surface aperture 169 is threaded.

Further, in this exemplary embodiment, the rear ballasts 168 are detachably engaged to the club head body 112. The rear ballasts 168 form one or more through apertures 170 and preferably forms the same quantity of back surface apertures 169 that is formed on the back surface 119 of the club head body 112. The rear ballasts through apertures 170 are configured to align with the back-surface apertures 169 and partially viewable from a bottom (sole) view. Each rear ballast through aperture 170 and back surface aperture 169 that is aligned are configured to receive a rear ballast fastener 171. The rear ballasts fastener 171 can be threaded to clamp or couple the rear ballast 168 to the club head body 112. The rear ballast 168 can be interchangeable with another rear ballast 168 of a different mass upon unfastening of the rear ballast fastener 171. The rear ballast fastener 171 needs only be unfastened by a quarter turn to uncouple the rear ballasts 168. In other embodiments, the rear ballasts 168 entirely forms the through apertures 170 (not visible from a bottom (sole) or top (top rail) view. This type of aperture 170 arrangement requires the fastener to be completely unthreaded from the aperture, rather than a quarter turn.

II. EMBODIMENT II

Integrally Coupling Lie Arm and Hosel Body

Another embodiment according to this invention is described below. This embodiment is substantially similar to the above described embodiment. Only the differences between the first embodiment and the second embodiment will be discussed below. Integrally coupling the lie arm to the hosel body includes many beneficial advantages, including, but not limited to, reducing the machining time, assembly time, and skill needed to couple the lie arm and the hosel body together.

Figure 36:
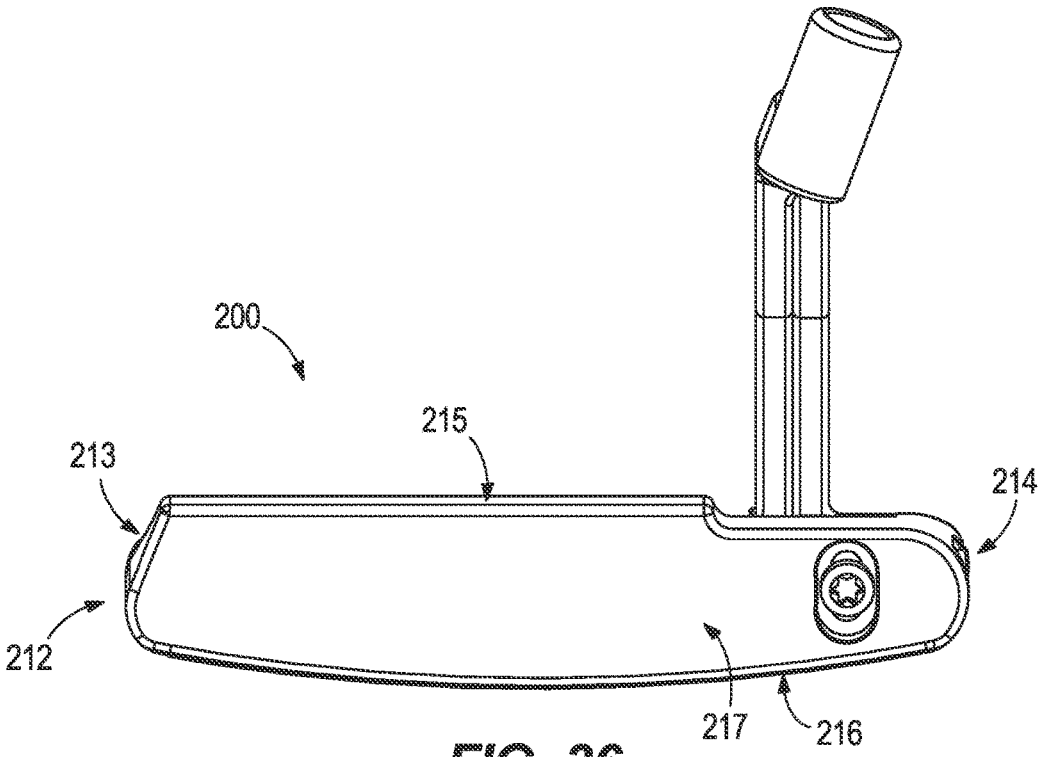
FIG. 36 shows a front view of the putter-type golf club head according to another embodiment.
Figure 37:
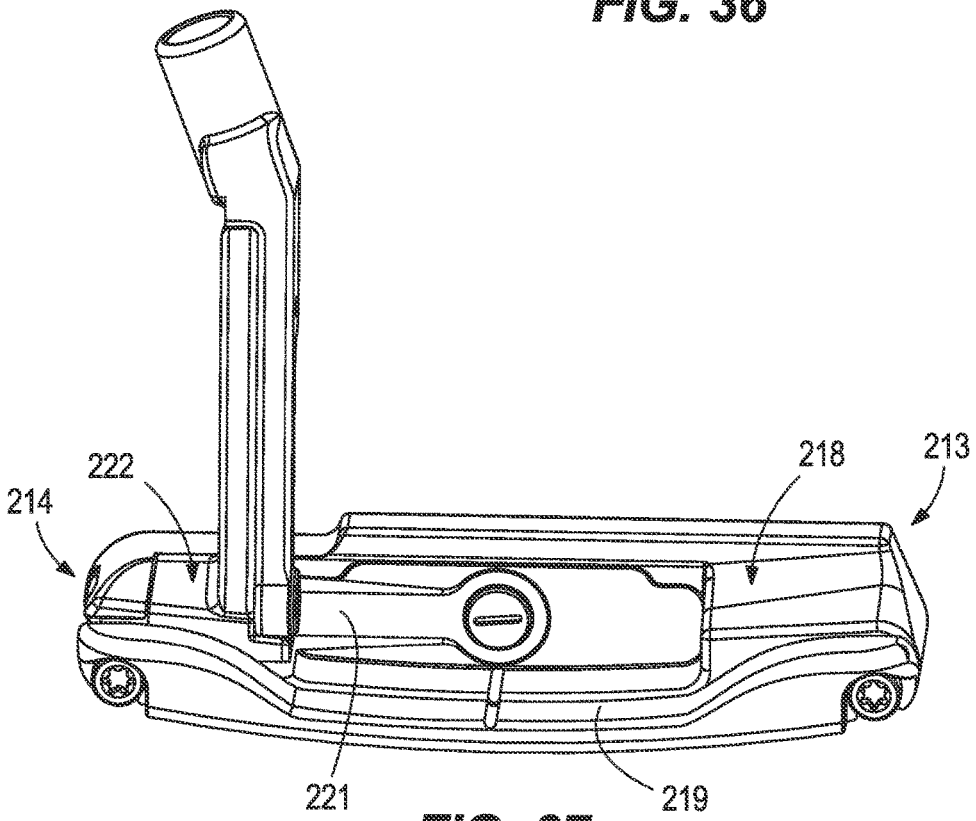
FIG. 37 shows a rear view of the putter-type golf club head of FIG. 36.
Figure 38:
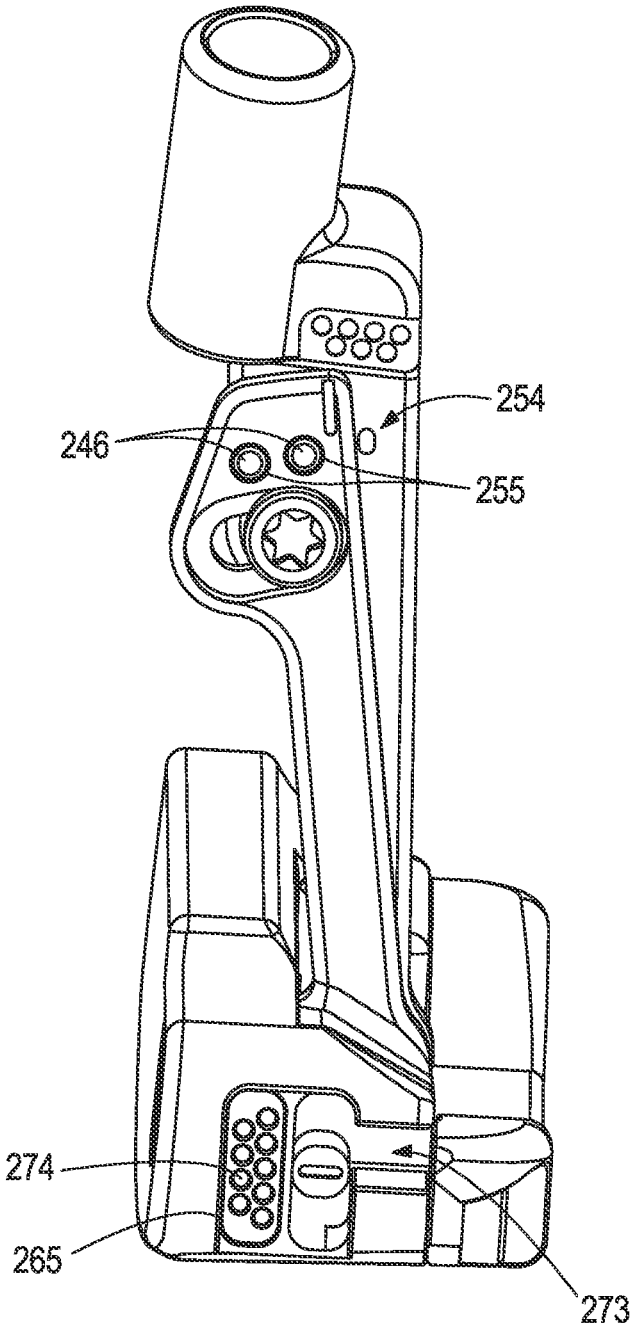
FIG. 38 shows a heel view of the putter-type golf club head of FIG. 37.

FIGS. 36-38 illustrates another embodiment according to this invention. FIG. 36 illustrates a front view of an embodiment according to some aspects of this invention. FIG. 37 illustrates a rear view of an embodiment according to some aspects of this invention. FIG. 38 illustrates a heel-side view of an embodiment according to some aspects of this invention.

The putter-type golf club head 200 comprises a club head body 212. The club head body 212 comprises a front striking surface 217, a rear surface 218 spaced from the front striking surface 217, a back surface 219 opposite the front striking surface 217, a sole 216 extending between the front striking surface 217 and the back surface 219, a top rail 215 opposite the sole 216, and the front striking surface 217 disposed between the heel end 214 and the toe end 213.

FIG. 38 illustrates a heel side view of the putter-type golf club head 200. A difference between Embodiment I (Mechanically Attaching Lie Arm to Hosel Body) and Embodiment II (Integrally Coupling Lie Arm to Hosel Body) is the connection means between the lie arm 121, 221 and the hosel body 122, 222. In Embodiment I, the lie arm 121 is mechanically attached to the hosel body 122, meaning the lie arm 121 and the hosel body 122 are separate pieces. In Embodiment II, the lie arm 221 is integrally coupled to the hosel body 222, meaning, the hosel body 222 and lie arm 221 are formed from the same piece of material. By having the lie arm 221 integrally connected to the hosel body 222, this reduces the assembly time and skill to connect the two elements together.

As the lie arm 221 is integrally connected to the hosel body 222, the heel-to-toe length of the adjustable lie angle mechanism 101 is increased and fixed. To account for this increase in length, a portion of the heel side of the body forms an opening (not closed) or void 273. The opening or void 273 at the heel side of the body provides extra space to accommodate insertion of the integrally connected hosel body 222 and lie arm 221 into the club head body 212. This opening or void 273 can be seen both in a heel view and rear view of the putter type golf club head.

With continued reference to FIG. 38, the geometry of the loft arm top apertures 254 are pill shaped. Similarly, to Embodiment I, each hosel arm topmost mounting apertures 246 are configured to receive a plunger 255. The plungers 255 are configured to engage the pill shaped loft arm top apertures 254. Having the geometry of the loft arm top apertures 254 be pill shaped increases the surface area of the loft arm top apertures 254 (relative to a circular geometry). As more surface area is present, the tolerance stacking between the loft arm top apertures 254, hosel arm topmost mounting apertures 246, and plungers 255 are not required to be as tight or precise, which reduces the required machining tolerances, machining time, and cost.

Additionally, this embodiment illustrates a lie badge 274 attached to the cavity or the second portion of the double recess aperture not extending entirely through the heel end of the putter-type golf club head 200. The lie badge 274 can form a plurality of lie angle alignment markers 265 that are either formed into or protrude from a surface of the lie badge. The plurality of lie angle alignment markers 265 represent different lie angle configurations. Each of the plurality of lie angle markers 265 can be different colors from one another for easily identifying the current lie angle of the putter-type golf club head 200. The width of the lie badge can be between approximately 0.07 inch to approximately 1.4 inches. In some embodiments, the lie badge can be approximately 0.63 inch.

Various features and advantages of the disclosures are set forth in the following clauses.

Clause 1. A putter-type golf club head comprising: a club head body comprising a toe end; a heel end; a top rail; a sole; a post; a front striking surface; and a rear surface spaced from the front striking surface; wherein the rear surface, the sole, and the top rail defines a recess; a hosel comprising a hosel arm and a loft arm; wherein: the hosel arm comprises a hosel arm first end, a hosel arm second end, a hosel body, and a hosel tab; the loft arm comprises a loft arm first end and a loft arm second end; a lie arm comprising a lie arm first end, a lie arm second end, and a receiving geometry; wherein a portion of the receiving geometry defines an indentation that is complementary to the post geometry; wherein: the loft arm is configured to couple to a golf shaft; the post extends from the rear surface of the club head body; the hosel body is integrally connected to the hosel arm second end; the lie arm first end is attached to the hosel body; the hosel arm and the loft arm are pivotably engaged to one another at the hosel arm second end and the loft arm second end, respectively and configured to incrementally change a loft angle of the putter-type golf club head; the receiving geometry of the lever arm is adapted to engage the post and configured to incrementally adjust a lie angle of the putter-type golf club head; and the hosel tab is attached to the hosel body and partially exposed at a heel end of the club head body.

Clause 2. The putter-type golf club head of claim 1, wherein the loft angle of the putter type golf club head changes in 1-degree increments.

Clause 3. The putter-type golf club head of claim 1, wherein the lie angle of the putter type golf club head changes in 1-degree increments.

Clause 4. The putter-type golf club head of claim 1, wherein a rear portion of the club head body further includes a rear ballast.

Clause 5. The putter-type golf club head of claim 4, wherein the rear ballast is arranged to be detachably engaged to the rear portion of the club head body and configured to incrementally adjust a head mass of the putter-type golf club head.

Clause 6. The putter-type golf club head of claim 1, wherein the rear surface further forms a plurality of conical recesses, and wherein the hosel body forms at least two threaded receiving ports.

Clause 7. The putter-type golf club head of claim 6, wherein the putter-type golf club head further comprises at least two spring plungers configured to be received within the at least two threaded receiving ports of the hosel body.

Clause 8. The putter-type golf club head of claim 7, wherein at least one spring plunger is always configured to be received within one of the plurality of conical recesses of the rear surface and the other one of the at least one spring plunger is always configured to be in a space between the plurality of conical recesses.

Clause 9. The putter-type golf club head of claim 8, wherein the plurality of conical recesses of the rear surface are spaced in either two- or three-degree increments.

Clause 10. The putter-type golf club head of claim 9, wherein the at least two threaded receiving ports of the hosel body are spaced approximately 5 degrees from one another.

Clause 11. The putter-type golf club head of claim 1, wherein the putter-type golf club head includes a plurality of markings to visually assist a user during a lie angle adjustment process.

Clause 12. The putter-type golf club head of claim 1, wherein the putter-type golf club head includes a plurality of markings to visually assist a user during a loft angle adjustment process.

Clause 13. The putter-type golf club head of claim 1, wherein the loft arm first end forms a plurality of conical recesses.

Clause 14. The putter-type golf club head of claim 1, wherein the hosel arm first end forms a plurality of threaded apertures.

Clause 15. The putter-type golf club head of claim 14, wherein at least two spring plungers are configured to be received within the at least two threaded receiving apertures of the hosel arm first end.

Clause 16. The putter-type golf club head of claim 15, wherein at least one spring plunger is always configured to be received within one of the plurality of conical recesses of the loft arm and the other one of the at least one spring plunger is always configured to be in a space between the plurality of conical recesses of the loft arm.

Clause 17. The putter-type golf club head of claim 16, wherein adjustment of the loft angle repositionably adjusts which plurality of conical recesses the at least one spring plunger is received within.

Clause 18. The putter-type golf club head of claim 8, wherein adjustment of the lie angle repositionably adjusts which plurality of conical recesses the at least one spring plunger is received within.

Clause 19. The putter-type golf club head of claim 1, wherein the putter-type club head is structurally configured to resemble a blade style putter.

Clause 20. The putter-type golf club head of claim 1, wherein the loft angle of the putter is less than 7 degrees.

What is claimed is:

1. A putter-type golf club head comprising:

a club head body comprising a toe end; a heel end; a top rail; a sole; a front striking surface; and a rear surface spaced from the front striking surface; wherein the rear surface, the sole, and the top rail defines a recess;

a hosel comprising a hosel arm and a loft arm; wherein:

the hosel arm comprises a hosel arm first end, a hosel arm second end, and a hosel body; and the loft arm comprises a loft arm first end and a loft arm second end; and a fastener;

wherein:

the loft arm is configured to couple to a golf shaft;

the hosel arm extends generally in a top rail-to-sole direction;

the hosel arm and the loft arm are pivotably engaged to one another below the top rail of the club head body at the hosel arm second end and the loft arm second end, and are configured to incrementally change a loft angle of the putter-type golf club head;

the loft angle is incrementally adjustable to angles less than 10 degrees;

the loft arm first end forms a loft arm middle aperture and a plurality of loft arm top apertures, both positioned closer to the loft arm first end than the loft arm second end;

the hosel arm forms a hosel arm mounting aperture and at least one plunger aperture, both positioned closer to the hosel arm first end than the hosel arm second end;

at least one spring plunger is secured into the at least one plunger aperture and engages the plurality of loft arm top apertures;

the loft arm middle aperture and the hosel arm mounting aperture receive the fastener; and the fastener allows adjustment of the loft angle by releasably securing the hosel arm and the loft arm;

wherein:

the loft arm second end forms a loft arm lower aperture;

the hosel arm second end forms a hosel arm lower mounting aperture;

a bolt pivotably couples the loft arm and the hosel arm by extending through the loft arm lower aperture and the hosel arm lower mounting aperture; and an arrangement of the bolt, the hosel arm, and the loft arm allows the loft arm to rotate in a front striking surface-to-rear surface direction, to adjust the loft angle, and the loft arm lower aperture is a counterbore; wherein the counterbore provides an abutment surface for a bearing.

2. The putter-type golf club head of claim 1, wherein the loft angle of the putter-type golf club head is adjustable to an angle between 0 and 8 degrees.

3. The putter-type golf club head of claim 1, wherein the loft angle of the putter-type golf club head changes in 1-degree increments.

4. The putter-type golf club head of claim 1, wherein the putter-type golf club head includes a plurality of loft angle alignment markings to visually assist a user during a loft angle adjustment process.

5. The putter-type golf club head of claim 1, wherein the plurality of loft arm top apertures comprises at least one recess having a shape selected from a group consisting of: conical, pill shaped, cylindrical, pyramidal, and funnel-shaped.

6. The putter-type golf club head of claim 1, wherein:

upon release of the fastener from the loft arm middle aperture and the hosel arm mounting aperture; and the at least one spring plunger is configured to be repositionable within one of the plurality of loft arm top apertures.

7. The putter-type golf club head of claim 1, wherein the loft arm middle aperture is threaded;

the fastener has a first diameter and is configured to thread into the loft arm middle aperture;

the hosel arm mounting aperture comprises a second diameter larger than the first diameter of the fastener to permit adjustment of the fastener within the hosel arm mounting aperture when the loft angle is adjusted.

8. The putter-type golf club head of claim 1, wherein:

the at least one plunger aperture comprises two plunger apertures spaced apart from one another by a degree spacing distance measured in reference to an imaginary circle with a center at a hosel arm pivot point, at the hosel arm second end, and extending through each of the two plunger apertures; and the degree spacing distance is selected from a group consisting of: one degree, two degrees, three degrees, four degrees, five degrees, six degrees, seven degrees, eight degrees, nine degrees, ten degrees, eleven degrees, twelve degrees, thirteen degrees, fourteen degrees, fifteen degrees, sixteen degrees, seventeen degrees, eighteen degrees, nineteen degrees, and twenty degrees.

9. The putter-type golf club head of claim 1, wherein a rear portion of the club head body further includes a rear ballast.

10. The putter-type golf club head of claim 9, wherein the rear ballast is arranged to be detachably engaged to the rear portion of the club head body and configured to adjust a head mass of the putter-type golf club head.

11. The putter-type golf club head of claim 1, wherein the hosel body is integrally connected to the hosel arm second end; and the hosel body connects to the club head body.

12. The putter-type golf club head of claim 1, wherein a loft badge is attached to the loft arm first end;

wherein the loft badge forms a plurality of loft angle alignment markers.

13. The putter-type golf club head of claim 1, wherein the club head body rear surface forms at least two back surface apertures;

wherein the at least two back surface apertures comprise a first back surface aperture positioned proximal to the club head body heel end; and a second back surface aperture positioned proximal to the club head body toe end.

14. The putter-type golf club head of claim 13, wherein the first back surface aperture and the second back surface aperture are threaded.

15. The putter-type golf club head of claim 1, wherein the hosel arm mounting aperture is pill shaped.

* * * * *